US009723412B2

(12) United States Patent
Miyoshi

(10) Patent No.: US 9,723,412 B2
(45) **Date of Patent: *Aug. 1, 2017**

(54) SPEAKER SYSTEM

(71) Applicant: FUJIFILM Corporation, Tokyo (JP)

(72) Inventor: Tetsu Miyoshi, Ashigara-kami-gun (JP)

(73) Assignee: FUJIFILM Corporation, Tokyo (JP)

( * ) Notice: Subject to any disclaimer, the term of this patent is extended or adjusted under 35 U.S.C. 154(b) by 27 days.

This patent is subject to a terminal disclaimer.

(21) Appl. No.: 14/867,128

(22) Filed: Sep. 28, 2015

(65) Prior Publication Data

US 2016/0021465 A1 Jan. 21, 2016

Related U.S. Application Data

(63) Continuation of application No. PCT/JP2014/059325, filed on Mar. 28, 2014.

(30) Foreign Application Priority Data

Mar. 29, 2013 (JP) ..... 2013-074494

(51) Int. Cl.
*H04R 17/00* (2006.01)
*H04R 3/04* (2006.01)
*H04R 31/00* (2006.01)

(52) U.S. Cl.
CPC ..... *H04R 17/005* (2013.01); *H04R 3/04* (2013.01); *H04R 31/00* (2013.01); *H04R 2307/025* (2013.01)

(58) Field of Classification Search
CPC . H04R 17/02; H04R 2217/00–2217/03; H04R 19/00–19/01; H04R 19/013;
(Continued)

(56) References Cited

U.S. PATENT DOCUMENTS

2010/0061573 A1* 3/2010 Fujise ..... H04R 17/00 381/190
2013/0256581 A1 10/2013 Miyoshi et al.
2014/0003634 A1* 1/2014 Ito ..... C08L 101/10 381/190

FOREIGN PATENT DOCUMENTS

JP 62-3598 A 1/1987
JP 63-97998 U 6/1988
(Continued)

OTHER PUBLICATIONS

Japanese Office Action for Japanese Application No. 2014-069303, dated Dec. 15, 2015, with a partial English translation.
(Continued)

*Primary Examiner* — Suhan Ni
(74) *Attorney, Agent, or Firm* — Birch, Stewart, Kolasch & Birch, LLP

(57) ABSTRACT

The present invention provides a speaker system comprising: an electroacoustic converter film composed of a polymeric composite piezoelectric body in which piezoelectric body particles are dispersed in a viscoelastic matrix formed of a polymer material that exhibits viscoelasticity at normal temperature, and thin film electrodes formed on both surfaces of the polymeric composite piezoelectric body; and a driving circuit that attenuates signal intensity of an input signal from a signal source at a rate of 5 dB to 7 dB per octave and supplies the attenuated input signal to the electroacoustic converter film.

16 Claims, 23 Drawing Sheets

(58) Field of Classification Search
CPC ..... H04R 19/016; H04R 1/02; H04R 1/025; H04R 1/026; H04R 7/00; H04R 2207/00
USPC ..... 381/173, 190, 191, 386, 426
See application file for complete search history.

(56) References Cited

FOREIGN PATENT DOCUMENTS

| | | | |
|---|---|---|---|
| JP | 6-70397 | U | 9/1994 |
| JP | 2002-369290 | A | 12/2002 |
| JP | 2006-339834 | A | 12/2006 |
| JP | 2008-124738 | A | 5/2008 |
| JP | 2008-294493 | A | 12/2008 |
| JP | 4426738 | B2 | 3/2010 |
| JP | 2012-142546 | A | 7/2012 |

OTHER PUBLICATIONS

English translation of the International Preliminary Report on Patentability and Written Opinion of the International Searching Authority, dated Oct. 8, 2015, for International Application No. PCT/JP2014/059325.
International Search Report, issued in PCT/JP2014/059325, dated Apr. 28, 2014.
Japanese Office Action, dated Jul. 12, 2016, for Japanese Application No. 2014-069303, including a machine translation.

* cited by examiner

SPEAKER SYSTEM

CROSS-REFERENCE TO RELATED APPLICATIONS

This application is a Continuation of PCT International Application No. PCT/JP2014/059325 filed on Mar. 28, 2014, which claims priority under 35 U.S.C. §119(a) to Japanese Patent Application No. 2013-074494 filed on Mar. 29, 2013. The above application is hereby expressly incorporated by reference, in its entirety, into the present application.

BACKGROUND OF THE INVENTION

The present invention relates to a speaker system using a sheet-like diaphragm utilizing a piezoelectric body.

In recent years, a speaker using a sheet-like diaphragm utilizing a piezoelectric body has been actively studied.

For example, JP 4426738 B discloses a speaker in which a piezoelectric ceramic is stuck to a diaphragm such as a resin or a metal, a voltage corresponding to a signal is applied to the piezoelectric ceramic to convert an expansion and contraction motion of the piezoelectric ceramic into a bending motion of the diaphragm, and thereby generating sound (a sound wave).

Furthermore, a speaker utilizing, as a vibration body, a so-called piezoelectric film in which an electrode layer is formed on each of both surfaces of a sheet-like piezoelectric material, such as a polymeric piezoelectric material, for example, a uniaxially stretched polyvinylidene fluoride (PVDF) film, or a polymeric composite piezoelectric body in which piezoelectric ceramic particles in a powder form are dispersed in a polymer material as a matrix, has also been used (JP 2008-294493 A).

In general, in a direct radiator speaker, an output sound pressure from the speaker is proportional to vibration acceleration of a vibration body. Accordingly, in order to make frequency characteristics of output sound constant, it is necessary to make the acceleration of the vibration body constant irrespective of a frequency.

Here, in a vibration model with one degree of freedom such as a cone speaker, in which sound is generated by piston motion of a diaphragm (cone paper) reciprocating back and forth, it is known that a frequency band lower than the lowest resonance frequency is an elasticity control area in which displacement is constant, the vicinity of the resonance frequency is a resistance control area in which speed is constant, and a frequency band higher than the resonance frequency is a mass control area in which acceleration is constant, as conceptually illustrated in FIG. 29. Therefore, in the conventional speaker, the lowest resonance frequency is lowered below a frequency band to be used so as to realize a uniform output sound pressure in the frequency band to be used.

A lowest resonance frequency $f_0$ is expressed as $f_0=\frac{1}{2}\pi\times\sqrt{(s/m)}$ (s: stiffness, and m: mass). Thus, the cone speaker has been devised to have small stiffness and great mass in a vibration system so as to lower the lowest resonance frequency.

Incidentally, since the piezoelectric speaker has a mechanism in which an expansion and contraction motion of a diaphragm (piezoelectric body) itself is converted into a bending motion to generate sound, unlike an ideal piston motion as in the cone speaker, it is necessary for the diaphragm itself to be as soft as possible and be heavy in order to lower the lowest resonance frequency.

SUMMARY OF THE INVENTION

However, although a piezoelectric ceramic has high specific gravity, it is very hard. Accordingly, it is difficult for the piezoelectric ceramic to lower the lowest resonance frequency.

Furthermore, a polymeric piezoelectric material such as PVDF is relatively soft, but has low specific gravity. Accordingly, it is also difficult for the polymeric piezoelectric material to lower the lowest resonance frequency.

In contrast, in the case of the piezoelectric film formed of a polymeric composite piezoelectric body, since piezoelectric ceramic particles having high specific gravity are dispersed therein, the piezoelectric film can be heavier than the polymeric piezoelectric material, and by using a soft (great loss tangent) polymer material as a matrix material, it is possible to lower the lowest resonance frequency. However, there is a problem in that, when the polymer material is merely soft, the vibration energy of the piezoelectric ceramic particles is absorbed, and thus energy efficiency deteriorates.

Incidentally, since the sheet-like diaphragm utilizing the piezoelectric body performs bending vibration in various modes, it has resonance frequencies corresponding to the respective modes in addition to the lowest resonance frequency. Accordingly, generally, when a piezoelectric ceramic having a large mechanical quality factor (Q value) is used for a diaphragm, the diaphragm exhibits sound pressure-frequency characteristics having a peak of a sound pressure level in the vicinity of each resonance frequency, as conceptually illustrated in FIG. 30, and this is undesirable in audibility. Here, the mechanical quality factor (Q value) is an index of the sharpness (strength of resonance) of the resonance characteristics.

In contrast, in the case of the polymeric composite piezoelectric body, by using a soft (high loss tangent) polymer material as the matrix, the mechanical quality factor (Q value) becomes small. However, it was found that although the sound pressure-frequency characteristics become smooth, it become a straight line rising to the right, as conceptually illustrated in FIG. 7A. This is because the half width of each resonance peak is widened, and as a result, the almost entire area becomes the resistance control area in which speed is constant. That is, since the vibration acceleration is a value obtained by multiplying speed by the frequency, the acceleration increases in proportion to the frequency, and as a result, the output sound pressure increases at 6 dB/octave.

As described above, by using a soft (high loss tangent) polymer material as the matrix material of the polymeric composite piezoelectric body, the lowest resonance frequency is lowered, and at the same time, smooth sound pressure-frequency characteristics are obtained. However, the output sound pressure increases linearly at 6 dB/octave, and this leads to a problem in that audio signals in which a treble side is emphasized as compared to the input signals are output.

The present invention has been made in view of the above-described problems, and an object thereof is to provide a speaker system that achieves uniform sound pressure level-frequency characteristics in a frequency band to be used, and further, is excellent in acoustic characteristics, in a speaker system that uses a sheet-like diaphragm utilizing a piezoelectric body.

In order to achieve the above object, the present invention provides a speaker system comprising: an electroacoustic converter film composed of a polymeric composite piezoelectric body in which piezoelectric body particles are dispersed in a viscoelastic matrix formed of a polymer material that exhibits viscoelasticity at normal temperature, and thin film electrodes formed on both surfaces of the polymeric composite piezoelectric body; and a driving circuit that attenuates signal intensity of an input signal from a signal source at a rate of 5 dB to 7 dB per octave and supplies the attenuated input signal to the electroacoustic converter film.

In the speaker system of the present invention, preferably, the electroacoustic converter film has a protective layer that is formed on a surface of at least one of the thin film electrodes.

Preferably, the driving circuit attenuates the signal intensity of the input signal at a rate of 6 dB per octave and supplies the attenuated input signal to the electroacoustic converter film.

Preferably, the driving circuit includes a low pass filter that attenuates the signal intensity of the input signal of which a frequency is equal to or higher than a predetermined first cutoff frequency at a rate of 6 dB per octave, and a constant voltage type amplifier that amplifies the input signal.

Preferably, the first cutoff frequency is a frequency lower than a lowest resonance frequency of the electroacoustic converter film.

Preferably, the driving circuit includes a constant current type amplifier that amplifies the input signal.

Preferably, the driving circuit further includes a high pass filter that attenuates the signal intensity of the input signal of which a frequency is equal to or lower than a predetermined second cutoff frequency.

Preferably, the second cutoff frequency is equal to or lower than the first cutoff frequency.

Preferably, the speaker system further comprises a viscoelastic support that is disposed in close contact with at least one main surface of the electroacoustic converter film.

Preferably, the viscoelastic support comprises at least one of glass wool, paper, polyurethane, a magnetic fluid, polyester wool, a coating material, and felt.

Preferably, the polymer material is one or more selected from a group consisting of cyanoethylated polyvinyl alcohol, polyvinyl acetate, polyvinylidene chloride co-acrylonitrile, a polystyrene-vinyl polyisoprene block copolymer, polyvinyl methyl ketone, and polybutyl methacrylate.

Preferably, the polymer material has a cyanoethyl group or a cyanomethyl group.

According to the present invention, it is possible achieve a speaker system in which a sheet-like diaphragm is used as a vibration body of the speaker, uniform frequency characteristics are obtained in a frequency band to be used, and acoustic characteristics are excellent.

Furthermore, according to the present invention, it is possible to achieve a speaker system that is thin and lightweight, has excellent flexibility, and is capable of outputting a stable acoustic signal even when it is deformed.

BRIEF DESCRIPTION OF THE DRAWINGS

FIG. 18A is a diagram illustrating the influence of the thickness of the protective layer, and FIG. 18B is a diagram illustrating the influence of the thickness of the thin film electrode.

DETAILED DESCRIPTION OF THE INVENTION

Hereinafter, a speaker system of the present invention will be described in detail based on preferred embodiments illustrated in the accompanying drawings.

Figure 1:
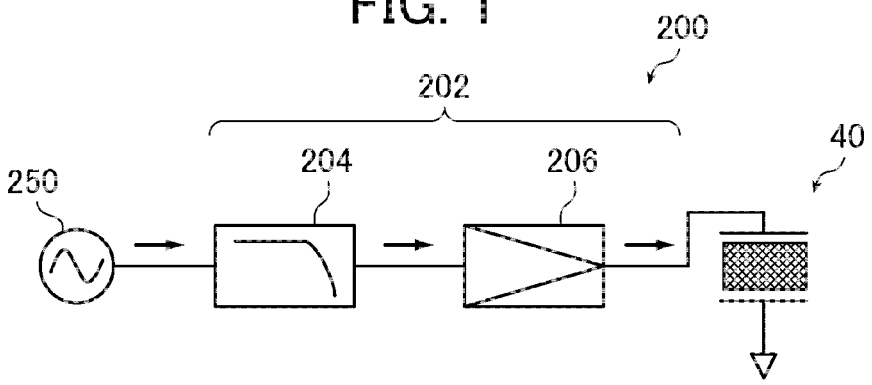
FIG. 1 is a circuit diagram conceptually illustrating an example of a speaker system of the present invention.

FIG. 1 conceptually illustrates a circuit diagram of an example of a speaker system of the present invention.

A speaker system 200 illustrated in FIG. 1 is configured with a piezoelectric speaker 40, and a driving circuit 202 that has a low pass filter 204 and a constant voltage type amplifier 206, amplifies an input signal from a signal source 250, and drives the piezoelectric speaker 40.

As will be described later in detail, in the speaker system of the present invention, a polymeric composite body formed by dispersing piezoelectric body particles in a viscoelastic matrix formed of a polymer material that exhibits viscoelasticity at normal temperature is used as a diaphragm of the speaker, thereby lowering the lowest resonance frequency, and at the same time reducing resonance peaks based on various modes of a bending motion due to a small mechanical quality factor (Q value). Furthermore, in the speaker system of the present invention, correction of attenuating the signal intensity of an input signal at a rate of 6 dB per octave is performed, thereby realizing uniform sound pressure level-frequency characteristics in a frequency band to be used.

Figure 2A:
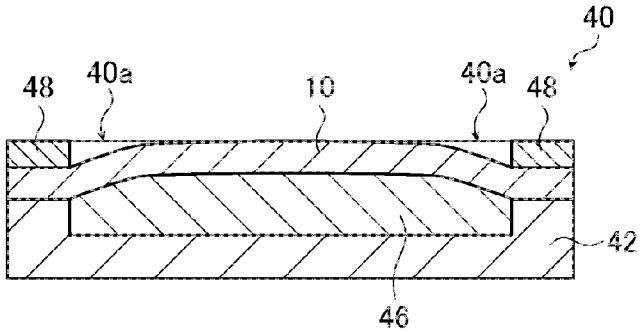
FIGS. 2A to 2C are conceptual views explaining an example of a piezoelectric speaker of the speaker system illustrated in FIG. 1.
Figure 2B:
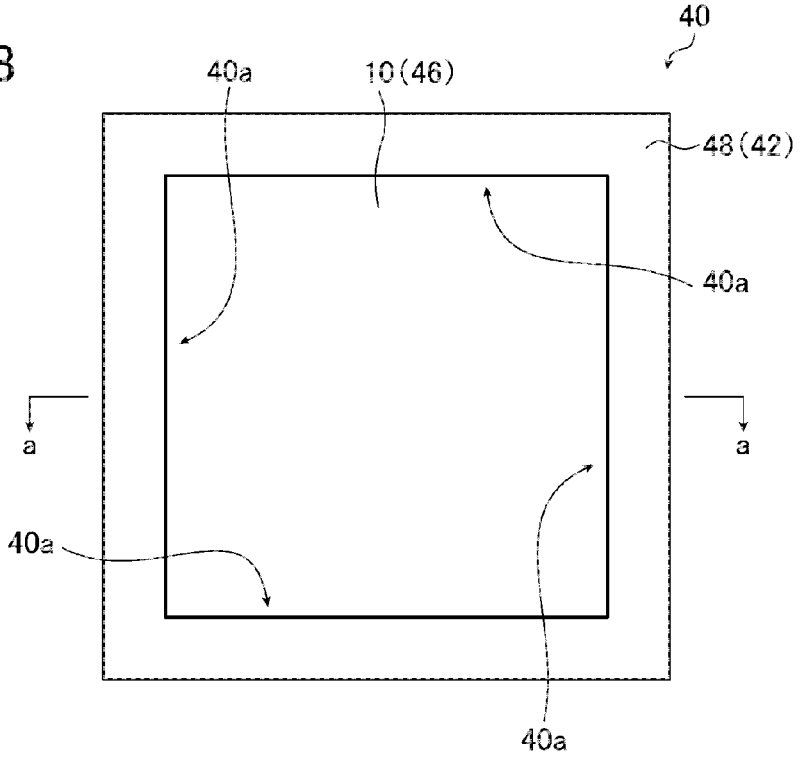

FIGS. 2A and 2B illustrate conceptual views of an example of the piezoelectric speaker 40. As illustrated in FIGS. 2A and 2B, the piezoelectric speaker 40 is a flat plate-type speaker. In FIGS. 2A and 2B, FIG. 2B is a view seen from a vibration direction (sound radiation direction) of an electroacoustic converter film 10, and FIG. 2A is a cross-sectional view taken along the line a-a in FIG. 2B and a view seen from a direction orthogonal to FIG. 2B.

The piezoelectric speaker 40 is configured with the electroacoustic converter film 10 (hereinafter, referred to as a converter film 10), a case 42, a viscoelastic support 46, and a frame 48.

The converter film 10 is a piezoelectric film composed of a piezoelectric body layer 12, the thin film electrodes 14 and 16 disposed at both sides of the piezoelectric body layer 12, and the protective layers 18 and 20 disposed on the surface of both the thin film electrodes, and the piezoelectric speaker 40 is a flat plate-type piezoelectric speaker which uses the converter film 10 as a speaker diaphragm converting electric signals into vibrational energy.

The converter film 10 will be described later in detail.

The case 42 is a chassis that is formed of plastic or the like and has the shape of a thin regular quadrangular cylinder of which one side is opened. In the piezoelectric speaker using the vibrating body of the present invention, the shape of the case 42 (that is, the piezoelectric speaker) is not limited to the quadrangular cylinder, and it is possible to use chassis having various shapes, such as a cylindrical chassis or a chassis having the shape of a quadrangular cylinder with a rectangular bottom surface.

The frame 48 is a plate material that has a through hole in the center thereof and has the shape similar to the top edge surface (surface of the opened side) of the case 42.

Further, the viscoelastic support 46 has an appropriate degree of viscosity and elasticity and supports the converter film 10. Moreover, the viscoelastic support 46 applies a constant mechanical bias to the piezoelectric film at any location of the film, such that the expansion and contraction motion of the converter film is completely converted into forward and backward motion (motion performed in the direction perpendicular to the film surface). Examples of the viscoelastic support 46 include non-woven fabrics such as wool felt and rayon- or PET-containing wool felt, glass wool, polyester wool, foamed materials (foamed plastics) such as polyurethane, laminate composed of a plurality of pieces of paper, coating materials, and the like.

In the example illustrated by the drawing, the viscoelastic support 46 has the shape of a quadrangular prism of which the bottom surface is approximately the same as the bottom surface of the case 42. The specific gravity of the viscoelastic support 46 is not particularly limited and may be appropriately selected according to the type of the viscoelastic support. For example, when felt is used as the viscoelastic support, the specific gravity thereof is preferably 50 $kg/m^3$ to 500 $kg/m^3$, and more preferably 100 $kg/m^3$ to 300 $kg/m^3$. If glass wool is used as the viscoelastic support, the specific gravity thereof is preferably 10 $kg/m^3$ to 100 $kg/m^3$.

The piezoelectric speaker 40 is configured such that the viscoelastic support 46 is accommodated in the case 42, the case 42 and the viscoelastic support 46 are covered with the converter film 10, and the frame 48 is fixed to the case 42 in a state where the periphery of the converter film 10 is pressed against the top edge surface of the case 42 by the frame 48.

The method for fixing the frame to the case 42 is not particularly limited, and it is possible to use various known methods such as a method of using screws or bolts and nuts and a method of using a fixing jig.

Figure 2C:
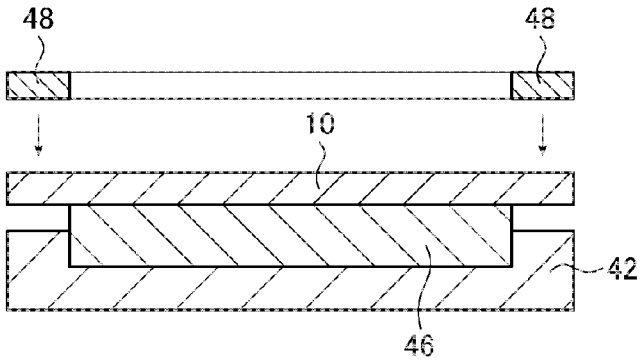

In the piezoelectric speaker 40, the viscoelastic support 46 has the shape of a quadrangular prism of which the height (thickness) is greater than the height of the inner surface of the case 42. That is, as schematically illustrated in FIG. 2C, in a state where the converter film 10 and the frame 48 have not yet been fixed, the viscoelastic support 46 protrudes out of the top surface of the case 42.

Consequently, in the piezoelectric speaker 40, the viscoelastic support 46 is held in a state where the thickness of the peripheral portion of the viscoelastic support 46 has been reduced since the peripheral portion is pressed downward by the converter film 10. Likewise, in the peripheral portion of the viscoelastic support 46, a radius of curvature of the converter film 10 sharply changes. Therefore, in the converter film 10, a rising portion (a tilt portion) 40*a* where the converter film 10 goes down toward the periphery of the viscoelastic support 46 is formed. In addition, the central region of the converter film 10 is pressed by the viscoelastic support 46 having the shape of a quadrangular prism and thus forms an (approximately) planar shape.

At this time, it is preferable for the entire surface of the viscoelastic support 46 to be pressed in the surface direction of the converter film 10, such that the overall thickness thereof is reduced.

In the piezoelectric speaker using the converter film 10, the pressure applied to the viscoelastic support 46 by the converter film 10 is not particularly limited. However, it is preferable to control the pressure to be about 0.05 MPa to 1.0 MPa, in particular to be about 0.02 MPa to 0.2 MPa expressed in terms of the surface pressure in the planar portion (flat portion).

The angle (tilt angle with respect to the planar portion of the center (average tilt angle)) of the rising portion 40*a* is not particularly limited. However, in view of making it possible for the converter film 10 to sufficiently perform up and down motion, it is preferable to set the tilt angle of the converter film 10 to about 3° to 90°, in particular to about 10° to 60°.

The difference in height of the converter film 10 (in the example illustrated in the drawing, a distance between a location closest to the bottom surface of the frame 48 and a location farthest from the bottom surface of the frame 48) is not particularly limited. However, in view of making it possible for the converter film 10 to constitute a thin planar speaker and to sufficiently perform up and down motion, it is preferable to set the difference to about 1 mm to 50 mm, in particular to about 5 mm to 20 mm.

In addition, the thickness of the viscoelastic support 46 is not particularly limited. However, the thickness of the viscoelastic support 46 not yet being pressed is preferably 1 mm to 100 mm, in particular 10 mm to 50 mm.

In such piezoelectric speaker 40, when the converter film 10 expands in the in-plane direction by the application of voltage to the piezoelectric body layer 12, in order for the expansion to be absorbed, the rising portion 40*a* of the converter film 10 slightly changes its angle in the rising direction thereof (direction in which the angle with respect to the surface direction of the converter film 10 becomes close to 90°). As a result, the converter film 10 having a planar portion moves upward (sound radiation direction).

In contrast, when the converter film 10 contracts in the in-plane direction by the application of voltage to the piezoelectric body layer 12, in order for the contraction to be absorbed, the rising portion 40*a* of the converter film 10 slightly changes its angle in a direction in which the rising portion 40*a* falls down (direction in which the rising portion 40*a* becomes close to a flat surface). As a result, the converter film 10 having a planar portion moves downward.

The piezoelectric speaker 40 generates sound by the vibration of the converter film 10.

In the rising portion 40*a* of the converter film 10, the viscoelastic support 46 is compressed in the thickness direction thereof as it is getting closer to the frame 48. However, due to an effect of static viscoelasticity (stress relaxation), the mechanical bias can be kept at the constant level at any location of the piezoelectric film. For this reason, the expansion and contraction motion of the piezoelectric film is completely converted into the forward and backward motion, and accordingly, it is possible to obtain a planar piezoelectric speaker which is thin, can produce sufficient volume, and has excellent acoustic characteristics.

In the piezoelectric speaker 40 illustrated as an example in the drawing, the entire periphery of the converter film 10 is pressed against the case 42 (that is, the viscoelastic support 46) by the frame 48. However, the present invention is not limited thereto.

That is, the piezoelectric speaker using the converter film 10 may not have the frame 48. For example, the piezoelectric speaker can be configured such that in the four corner sides of the case 42, the converter film 10 is pressed against/fixed to the top surface of the frame 48 by screws, bolts and nuts, jigs, and the like.

Moreover, an O-ring or the like may be disposed between the case 42 and the converter film 10. If the speaker has such configuration, it is possible to obtain a damper effect, and to obtain better acoustic characteristics by preventing the vibration of the converter film 10 from being transferred to the case 42.

Furthermore, the piezoelectric speaker using the converter film 10 may not have the case 42 accommodating the viscoelastic support 46.

Figure 3:
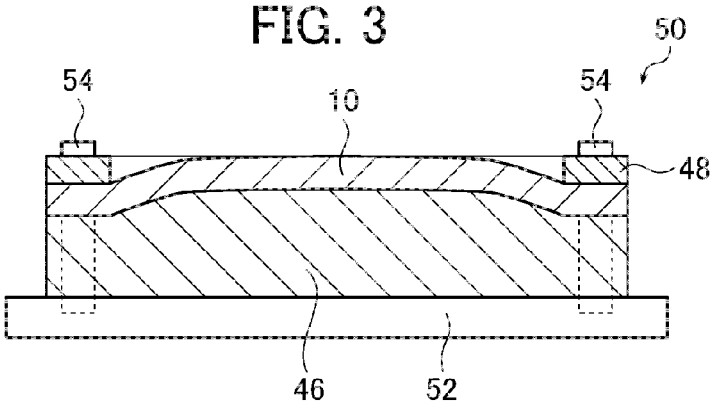
FIG. 3 is a view conceptually illustrating another example of the piezoelectric speaker used in the speaker system of the present invention.

That is, as schematically described in FIG. 3, which is the cross-sectional view of the piezoelectric speaker 50 as an example, the piezoelectric speaker can also be configured as follows. In the configuration, the viscoelastic support 46 is placed on a rigid support plate 52, the converter film 10 covering the viscoelastic support 46 is provided, and the aforementioned frame 48 is placed in the peripheral portion. Then, the frame 48 is fixed to the support plate 52 by screws 54 such that the frame 48 is pressed together with the viscoelastic support 46. In this manner, the peripheral portion of the viscoelastic support 46 becomes thin, and tilt portions of the converter film 10 are formed.

Even in this configuration not having the case 42, the viscoelastic support 46 may be held in a state of pressed to become thin by using screws or the like, without using the frame 48.

The size of the support plate 52 may be larger than that the piezoelectric speaker 50. If a variety of diaphragms formed of polystyrene, a foamed PET, a carbon fiber or the like is used as the material of the support plate 52, an effect of additional amplification of the vibration of the piezoelectric speaker can also be expected.

Moreover, the piezoelectric speaker using the converter film 10 is not limited to the configuration in which the periphery thereof is pressed. For example, the piezoelectric speaker can be configured such that the center of the laminate of the viscoelastic support 46 and the converter film 10 is pressed by certain means, and the viscoelastic support 46 is held in a state of a thin support.

That is, the piezoelectric speaker using the converter film 10 can be configured in various ways, as long as the viscoelastic support 46 is pressed by the converter film 10 and is held in a state where the thickness thereof has been reduced, a radius of curvature of the converter film 10 sharply changes due to the state of pressing/holding described above, and the rising portion 40*a* is formed in the converter film 10.

Alternatively, a configuration in which a resin film is pasted to the converter film 10 to give (hold) tension may be adopted. In a configuration in which the converter film 10 is held by the resin film, if the converter film 10 can be held in a state of being curved, it is possible to allow the speaker to be a flexible speaker.

Alternatively, a configuration in which the converter film 10 is stretched on a curved flame tight may be adopted.

The piezoelectric speaker illustrated in FIGS. 2A to 2C and 3 uses the viscoelastic support 46. However, the piezoelectric speaker using the converter film 10 is not limited to this configuration.

For example, a piezoelectric speaker 56 illustrated in FIG. 4C will be described.

Figure 4A:
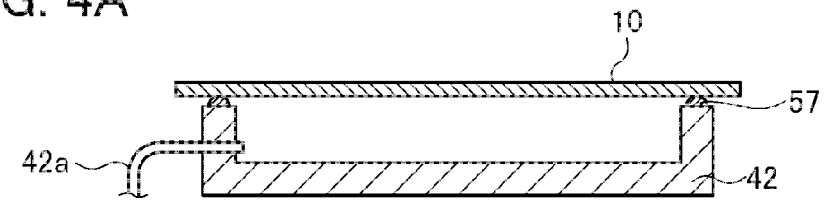
FIGS. 4A to 4C are conceptual views explaining another example of the piezoelectric speaker used in the speaker system of the present invention.

First, as shown in FIG. 4A, the piezoelectric speaker 56 uses a substance having airtightness as the aforementioned case 42 and is provided with a pipe 42*a* for injecting air into the case 42.

An O-ring 57 is disposed on the top surface of the edge at the opened side of the case 42, and is covered with the converter film 10 so as to close the opened surface of the case 42.

Figure 4B:
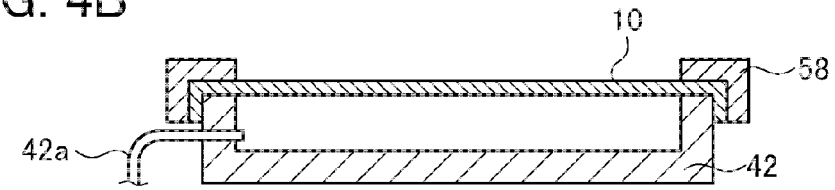
Figure 4C:
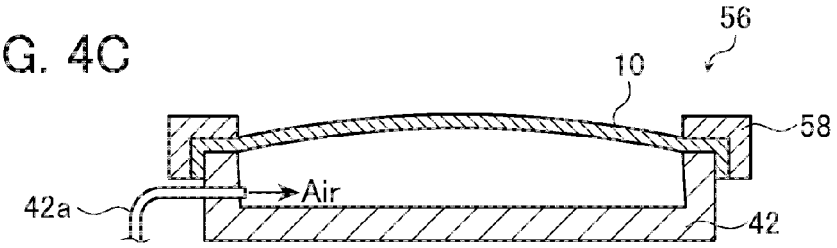

Thereafter, as shown in FIG. 4B, a frame-like press lid 58, which has inner circumference approximately the same as the outer circumference of the case 42 and has an approximately L-shaped cross-section, is caused to fit to the outer circumference of the case 42 (in FIGS. 4B and 4C, the O-ring 57 is not illustrated).

As a result, the converter film 10 is pressed against and fixed to the case 42, and the inside of the case 42 is closed in an airtight state by the converter film 10.

Subsequently, as shown in FIG. 4C, air is injected into the case 42 (closed space formed by the case 42 and the converter film 10) through the pipe 42*a*, such that the converter film 10 convexly bloats by being applied with pressure. This state is maintained to obtain the piezoelectric speaker 56.

The internal pressure of the case 42 is not limited and may be higher than atmospheric pressure at which the converter film 10 can convexly bloat outside.

Gases other than air may be injected into the case.

The pipe 42*a* may be fixed or may be attachable and detachable. Needless to say, when the pipe 42*a* is detached, the portion from which the pipe is detached needs to be closed in an airtight state.

When a configuration in which pressure is applied to the inside of the speaker is adopted, a distortion component may increase due to the influence of an air spring, and sound quality may decrease. In contrast, in the configuration in which the converter film 10 is supported by the viscoelastic support such as glass wool or felt, the distortion component does not increase since viscosity is given to the converter film 10, and thus, this configuration is suitable for a speaker.

Furthermore, other than gases, a substance such as a magnetic fluid or a coating material may be used to fill the case 42 as long as it can give appropriate viscosity to the converter film 10.

Hereinafter, the converter film 10 will be described in detail.

Figure 5:
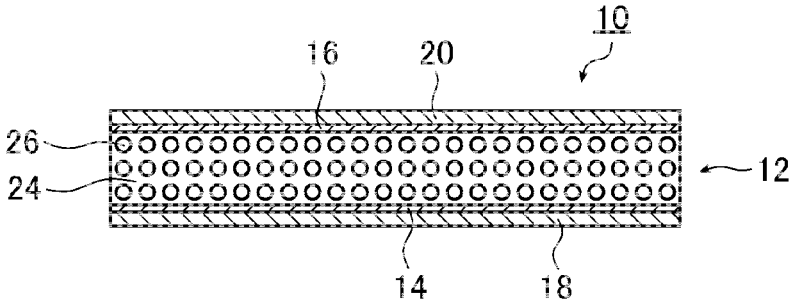
FIG. 5 is a conceptual view explaining an example of an electroacoustic converter film used in the speaker system of the present invention.

FIG. 5 schematically illustrates an example of the electroacoustic converter film 10.

The converter film 10 shown in FIG. 5 is basically configured with a piezoelectric body layer 12 that is formed of a polymeric composite piezoelectric body, a thin film electrode 14 that is disposed on one side of the piezoelectric body layer 12, a thin film electrode 16 that is disposed on the other side of the piezoelectric body layer 12, a protective layer 18 that is disposed on the surface of the thin film electrode 14, and a protective layer 20 that is disposed on the surface of the thin film electrode 16.

In the converter film 10, the piezoelectric body layer 12 is formed of the polymeric composite piezoelectric body.

In the present invention, the polymeric composite piezoelectric body forming the piezoelectric body layer 12 is obtained by uniformly dispersing piezoelectric body particles 26 in a viscoelastic matrix 24 formed of a polymer material that exhibits viscoelasticity at normal temperature. It is preferable for the piezoelectric body layer 12 to have undergone polarization processing.

It should be noted that in the present specification, the "normal temperature" refers to a temperature within a range of about 0° C. to 50° C.

Generally, polymer solids have a viscoelasticity relaxation mechanism. By the temperature increase or the decrease in frequency, a large scale of molecular motion of the polymer solids is observed as the decrease (relaxation) in a storage modulus (Young's modulus) or as the maximum (absorption) of a loss modulus. Particularly, the relaxation resulting from micro-Browninan motion of a molecular chain in an amorphous region is called primary dispersion and observed as an extremely large degree of relaxation. A temperature at which the primary dispersion occurs is a glass transition temperature (Tg), and the viscoelasticity relaxation mechanism is the most markedly observed at this temperature.

In the present invention, a polymer material having the glass transition temperature in the range of normal temperature, that is, a polymer material exhibiting viscoelasticity at normal temperature is used as a matrix in the polymeric composite piezoelectric body (piezoelectric body layer 12), whereby a polymeric composite piezoelectric body that exhibits hardness with respect to vibration of 20 Hz to 20 kHz while exhibiting softness with respect to slow vibration of a frequency of several Hz or lower is achieved. Especially, from the viewpoint of causing the polymeric composite piezoelectric body to behave preferably as above, it is preferable to use a polymer material, which has a glass transition temperature at a frequency of 1 Hz in a range of normal temperature, as a matrix of the polymeric composite piezoelectric body.

As the polymer material exhibiting viscoelasticity at normal temperature, various known materials can be used. Among these, it is preferable to use polymer materials of which the maximum value of a loss tangent Tan δ at a frequency of 1 Hz is 0.5 or higher at normal temperature when the maximum value is measured by a dynamic viscoelasticity test.

If such materials are used, when the polymeric composite piezoelectric body is gently bent by the external force, stress concentration caused in a polymer matrix-piezoelectric body particles interface in a portion where a bending moment becomes maximum is relaxed, and accordingly, a high degree of flexibility may be expected.

Moreover, a storage modulus (E') at a frequency of 1 Hz of the polymer material that is obtained by dynamic viscoelasticity measurement is preferably 100 MPa or higher at 0° C. and 10 MPa or lower at 50° C.

If the polymer material has the above property, the bending moment caused when the polymeric composite piezoelectric body is gently bent by the external force can be reduced, and the polymeric composite piezoelectric body can exhibit hardness with respect to acoustic vibration of 20 Hz to 20 kHz.

It is more preferable for the polymer material to have a dielectric constant of 10 or higher at 25° C.

If the polymer material has the above property, when voltage is applied to the polymeric composite piezoelectric body, a stronger electric field is applied to the piezoelectric body particles in the polymer matrix, hence larger degree of deformation may be expected.

However, on the other hand, a polymer material having a dielectric constant of less than 10 at 25° C. is also preferable in consideration of ensuring good moisture resistance or the like.

Examples of the polymer material satisfying the above conditions include cyanoethylated polyvinyl alcohol (cyanoethylated PVA), polyvinyl acetate, polyvinylidene chloride co-acrylonitrile, polystyrene-vinyl polyisoprene block copolymer, polyvinyl methyl ketone, polybutyl methacrylate, and the like. Further, commercially available products, such as HYBRAR 5127 (manufactured by Kuraray Co., Ltd.), are also suitably used as the polymer material.

Here, one kind of the polymer material may be used alone or plural kinds thereof may be used in combination (mixture).

In the present invention, the viscoelastic matrix 24 is not limited to a viscoelastic matrix formed of a single viscoelastic material, such as a single cyanoethylated PVA.

That is, for the purpose of adjusting dielectric characteristics, mechanical characteristics, and the like, other dielectric polymer materials may be optionally added to the viscoelastic matrix 24 in addition to the viscoelastic material such as cynoethylated PVA.

Examples of the addible dielectric polymer material include fluorine-based polymers such as polyvinylidene fluoride, vinylidene fluoride-tetrafluoroethylene copolymers, vinylidene fluoride-trifluoroethylene copolymers, polyvinylidene fluoride-trifluoroethylene copolymers, and polyvinylidene fluoride-tetrafluoroethylene copolymers; cyano group- or cyanoethyl group-containing polymers such as vinylidene cyanide-vinyl acetate copolymers, cyanoethyl cellulose, cyanoethyl hydroxysaccharose, cyanoethyl hydroxycellulose, cyanoethyl hydroxypullulan, cyanoethyl methacrylate, cyanoethyl acrylate, cyanoethyl hydroxyethyl cellulose, cyanoethyl amylose, cyanoethyl hydroxypropyl cellulose, cyanoethyl dihydroxypropyl cellulose, cyanoethyl hydroxypropyl amylose, cyanoethyl polyacrylamide, cyanoethyl polyacrylate, cyanoethyl pullulan, cyanoethyl polyhydroxymethylene, cyanoethyl glycidol pullulan, cyanoethyl saccharose, and cyanoethyl sorbitol; synthetic rubbers such as nitrile rubber and chloroprene rubber, and the like.

Among these, the cyanoethyl group-containing polymer materials are preferably used.

In addition, the dielectric polymer that can be added to the viscoelastic matrix 24 of the piezoelectric body layer 12 in addition to cyanoethylated PVA is not limited to one kind, and plural kinds thereof may be added.

Furthermore, in addition to the dielectric polymer, a thermoplastic resin such as a vinyl chloride resin, polyethylene, polystyrene, a methacrylic resin, polybutene and isobutylene, or a thermosetting resin such as a phenol resin, a urea resin, a melamine resin, an alkyd resin, and mica may be added for the purpose of adjusting a glass transition point Tg.

Moreover, a tackifier such as rosin ester, rosin, terpene, terpene phenol, and a petroleum resin may be added for the purpose of improving adhesiveness.

The amount of the polymer, which is added to the viscoelastic matrix 24 of the piezoelectric body layer 12, other than the viscoelastic material such as cyanoethylated PVA is not particularly limited. However, it is preferable for the polymer to be added in such an amount that a proportion of the polymer accounting for the viscoelastic matrix 24 becomes 30% by weight or less.

If the polymer is added in such an amount, characteristics of the added polymer material can be expressed without impairing the viscoelasticity relaxation mechanism in the viscoelastic matrix 24. Accordingly, from the viewpoints such as increase in a dielectric constant, improvement of heat resistance, and improvement of adhesiveness with the piezoelectric body particles 26 or the electrode layer, preferable results can be obtained.

The viscoelastic matrix 24 is not limited to a viscoelastic matrix containing a cyanoethylated PVA and, for example, a material having a cyanoethyl group such as cyanoethylated pullulan can be used. Alternatively, a material having a cyanomethyl group can be used as the viscoelastic matrix 24 (polymer material). Further, a material used as the viscoelastic matrix 24 preferably has viscoelasticity at normal temperature.

The piezoelectric body particles 26 are formed of ceramics particles having a perovskite crystal structure or a wurtzite crystal structure.

Examples of the ceramic particles composing the piezoelectric body particles 26 include lead zirconate titanate (PZT), lead lanthanum zirconate titanate (PLZT), barium titanate ($BaTiO_3$), zinc oxide (ZnO), a solid solution (BFBT) consisting of barium titanate and bismuth ferrite ($BiFe_3$), and the like.

In the present invention, the particle size of the piezoelectric body particles 26 is not particularly limited. However, according to the examination conducted by the present inventors, the particle size of the piezoelectric body particles 26 is preferably 1 μm to 10 μm.

If the particle size of the piezoelectric body particles 26 is within the above range, it is possible to obtain preferable results from the viewpoints that a high degree of piezoelectric characteristics becomes compatible with flexibility, and the like.

In FIG. 5, the piezoelectric body particles 26 in the piezoelectric body layer 12 have dispersed with regularity in the viscoelastic matrix 24. However, the present invention is not limited thereto.

That is, as long as the piezoelectric body particles 26 uniformly disperse in the piezoelectric body layer 12, they may not regularly disperse in the viscoelastic matrix 24.

In the converter film 10, the ratio between the amount of the viscoelastic matrix 24 and the amount of the piezoelectric body particles 26 in the piezoelectric body layer 12 (polymeric composite piezoelectric body) is not particularly limited. The ratio between the amount of the viscoelastic matrix 24 and the amount of the piezoelectric body particles 26 may be appropriately set according to the size (size in the surface direction) or thickness of the converter film 10, the use of the converter film 10, characteristics required for the converter film 10, and the like.

According to the examination conducted by the present inventors, the volumetric proportion of the piezoelectric body particles 26 in the piezoelectric body layer 12 is preferably 30% to 70% and particularly preferably 50% or higher. Therefore, the volumetric proportion is more preferably 50% to 70%.

If the ratio between the amount of the viscoelastic matrix 24 and the amount of the piezoelectric body particles 26 is within the above range, it is possible to obtain preferable results from the viewpoints that a high degree of piezoelectric characteristics become compatible with flexibility, and the like.

Moreover, in the converter film 10, the thickness of the piezoelectric body layer 12 is not particularly limited. The thickness may be appropriately set according to the size and use of the converter film 10, characteristics required for the converter film 10, and the like.

According to the examination conducted by the present inventors, the thickness of the piezoelectric body layer 12 is preferably 10 μm to 300 μm, more preferably 20 μm to 200 μm, and particularly preferably 30 μm to 100 μm.

If the thickness of the piezoelectric body layer 12 is within the above range, it is possible to obtain preferable results from the viewpoints that securing of rigidity and appropriate flexibility can be established at the same time, and the like.

It should be noted that as described above, it is preferable for the piezoelectric body layer 12 to have undergone polarization processing (polling). The detail of the polarization processing will be described later.

As illustrated in FIG. 5, the converter film 10 has a configuration in which the piezoelectric layer 12 is interposed between the thin film electrodes 14 and 16, and the thus obtained laminate is interposed between the protective layers 18 and 20.

In the converter film 10, the protective layers 18 and 20 play a role of imparting appropriate rigidity and mechanical strength to the polymeric composite piezoelectric body. That is, in the converter film 10, the polymeric composite piezoelectric body (piezoelectric body layer 12) consisting of the viscoelastic matrix 24 and the piezoelectric body particles 26 exhibits excellent flexibility when suffering from gentle bending deformation. However, depending on the use thereof, the rigidity or mechanical strength of the polymeric composite piezoelectric body is insufficient in some cases. The converter film 10 is provided with the protective layers 18 and 20 to correct such a flaw.

The protective layers 18 and 20 are not particularly limited, and various sheet-like substances can be used. Preferable examples thereof include various resin films (plastic films). Among these, polyethylene terephthalate (PET), polypropylene (PP), polystyrene (PS), polycarbonate (PC), polyphenylene sulfide (PPS), polymethyl methacrylate (PMMA), polyetherimide (PEI), polyimide (PI), polyethylene naphthalate (PEN), triacetylcellulose (TAC), and cyclic olefin resins are preferably used since these have excellent mechanical characteristics and heat resistance.

The thickness of the protective layers 18 and 20 is also not particularly limited. Basically, the protective layers 18 and 20 have the same thickness, but the thickness may be different.

If the rigidity of the protective layers 18 and 20 is too high, the expansion and contraction of the piezoelectric body layer 12 is restricted, and the flexibility is also impaired. Accordingly, except for the case that requires mechanical strength or excellent handleability as a sheet-like substance, the thinner the protective layers 18 and 20 are, the more advantageous the invention is.

According to the examination conducted by the present inventors, if the thickness of the protective layers 18 and 20 is not greater than two times the thickness of the piezoelectric body layer 12, it is possible to obtain preferable results from the viewpoints that securing of rigidity and appropriate flexibility can be established at the same time, and the like.

For example, when the thickness of the piezoelectric body layer 12 is 50 μm, and the protective layers 18 and 20 are formed of PET, the thickness of the protective layers 18 and 20 is preferably 100 μm or less, more preferably 50 μm or less, and particularly preferably 25 μm or less.

In the converter film 10, the thin film electrode 14 is formed between the piezoelectric body layer 12 and the protective layer 18, and the thin film electrode 16 is formed between the piezoelectric body layer 12 and the protective layer 20.

The thin film electrodes 14 and 16 are provided to apply an electric field to the converter film 10.

In the present invention, the material forming the thin film electrodes 14 and 16 is not particularly limited, and various conductive materials can be used. Preferable examples thereof specifically include carbon, palladium, iron, tin, aluminum, nickel, platinum, gold, silver, copper, chromium, molybdenum, alloys of these, indium tin oxide, and the like. Among these, any one of copper, aluminum, gold, silver, platinum, and indium tin oxide is preferable.

Moreover, the formation method of the thin film electrodes 14 and 16 is not particularly limited, and it is possible to use various known methods including a film formation method implemented by a vapor-phase deposition method (vacuum film formation method) such as vacuum deposition or sputtering, or plating, and a method of sticking foil formed of the above material to the piezoelectric body layer.

Particularly, a thin film of copper or aluminum formed by vacuum deposition is preferably used as the thin film electrodes 14 and 16, since this film can secure flexibility of the converter film 10. Especially, a thin copper film formed by vacuum deposition is suitably used.

The thickness of the thin film electrodes 14 and 16 is not particularly limited. Basically, the thin film electrodes 14 and 16 have the same thickness, but the thickness may be different.

As in the protective layers 18 and 20 described above, if the rigidity of the thin film electrodes 14 and 16 is too high, the expansion and contraction of the piezoelectric body layer 12 is restricted, and the flexibility is impaired. Accordingly, the thinner the thin film electrodes 14 and 16 are, the more advantageous the invention is, as long as the electric resistance does not become too high.

According to the examination conducted by the present inventors, it is preferable that a product of the thickness of the thin film electrodes 14 and 16 and a Young's modulus thereof be smaller than a product of the thickness of the protective layers 18 and 20 and a Young's modulus thereof, since the flexibility is not significantly impaired.

For example, when a combination of the protective layers 18 and 20 formed of PET (Young's modulus: about 6.2 GPa) and the thin film electrodes 14 and 16 formed of copper (Young's modulus: about 130 GPa) is used, provided that the thickness of the protective layers 18 and 20 is 25 μm, the thickness of the thin film electrodes 14 and 16 is preferably 1.2 μm or less, more preferably 0.3 μm or less, and particularly preferably 0.1 μm or less.

In addition, the thin film electrode 14 and/or the thin film electrode 16 are (is) not necessarily formed on the entire surface of the piezoelectric body layer 12 (the protective layer 18 and/or the protective layer 20).

That is, the converter film 10 may be configured such that at least one of the thin film electrodes 14 and 16 is smaller than, for example, the piezoelectric body layer 12, and the piezoelectric body layer 12 comes into direct contact with the protective layer in the peripheral portion of the converter film 10.

Alternatively, the protective layer 18 and/or the protective layer 20, in which the thin film electrode 14 and/or the thin film electrode 16 are (is) formed on the entire surface, are (is) not necessarily formed on the entire surface of the piezoelectric body layer 12. In this case, the converter film 10 may be configured such that another (second) protective layer that comes into direct contact with the piezoelectric body layer 12 may be additionally provided at the surface side of the protective layer 18 and/or the protective layer 20.

As described above, the converter film 10 has the configuration in which the piezoelectric body layer 12 (polymeric composite piezoelectric body), which is obtained by dispersing the piezoelectric body particles 26 in a viscoelastic matrix 24 exhibiting viscoelasticity at normal temperature, is interposed between the thin film electrodes 14 and 16, and the laminate obtained as above is interposed between the protective layers 18 and 20.

In the converter film 10, it is preferable that the maximum value of a loss tangent (Tan δ) at a frequency of 1 Hz, which is 0.1 or higher and is obtained by dynamic viscoelasticity measurement, be present at normal temperature.

If the maximum value is present at normal temperature, even if the converter film 10 externally experiences severe bending deformation which is caused relatively slow and of which the frequency is several Hz or lower, the strain energy can be caused to effectively diffuse outside in the form of heat. Accordingly, it is possible to prevent the interface between the polymer matrix and the piezoelectric body particles from cracking.

Furthermore, a storage modulus (E') at a frequency of 1 Hz of the converter film 10 that is obtained by dynamic viscoelasticity measurement is preferably 10 GPa to 30 GPa at 0° C. and 1 GPa to 10 GPa at 50° C.

If the storage modulus is as above, the converter film 10 can have large frequency dispersion in the storage modulus (E') at normal temperature. That is, the converter film 10 can exhibit hardness with respect to vibration of 20 Hz to 20 kHz while exhibiting softness with respect to vibration of a frequency of several Hz or lower.

In addition, in the converter film 10, a product of the thickness of the converter film 10 and the storage modulus (E') at a frequency of 1 Hz of the converter film 10 that is obtained by dynamic viscoelasticity measurement is preferably $1.0\times10^6$ N/m to $2.0\times10^6$ N/m (1.0 E+06 N/m to 2.0 E+06 N/m) at 0° C. and $1.0\times10^5$ N/m to $1.0\times10^6$ N/m (1.0 E+05 N/m to 1.0 E+06 N/m) at 50° C.

If the product is within the above range, the converter film 10 can have appropriate rigidity and mechanical strength within a range that does not impair flexibility and acoustic characteristics.

Moreover, in the converter film 10, it is preferable that the loss tangent (Tan δ) at a frequency of 1 kHz at 25° C. of the converter film 10 be 0.05 or higher in a master curve obtained by dynamic viscoelasticity measurement.

If the loss tangent is as above, the speaker using the converter film 10 has smooth frequency characteristics, and thus, when the lowest resonance frequency $f_0$ varies with the change in the curvature of the speaker, a degree of change in the sound quality can be reduced.

Next, an example of a manufacturing method of the electroacoustic converter film 10 will be described with reference to FIGS. 6A to 6E.

Figure 6A:
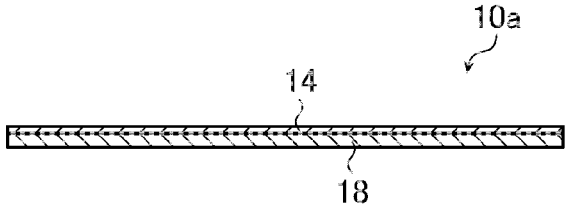
FIGS. 6A to 6E are conceptual views illustrating an example of a method of manufacturing the electroacoustic converter film illustrated in FIG. 5.

First, as shown in FIG. 6A, a sheet-like substance 10*a* in which the thin film electrode 14 is formed on the protective layer 18 is prepared.

The sheet-like substance 10*a* may be prepared by forming a thin copper film or the like as the thin film electrode 14 on the surface of the protective layer 18 by means of vacuum deposition, sputtering, plating, or the like.

When the protective layer 18 is very thin and handleability is poor, the protective layer 18 with a separator (temporary support) may be used, if necessary. For example, PET having a thickness of 25 μm to 100 μm may be used as the separator. After thermocompression bonding of the thin film electrode and the protective layer, the separator may be removed.

Alternatively, a commercially available product in which a thin copper film or the like is formed on the protective layer 18 may be used as the sheet-like substance 10*a*.

Meanwhile, a polymer material (hereinafter, also referred to as a viscoelastic material) such as cyanoethylated PVA that exhibits viscoelasticity at room temperature is dissolved in an organic solvent, the piezoelectric body particles 26 such as PZT particles are added thereto and dispersed by stirring, whereby a coating material is prepared. The organic solvent is not particularly limited, and various organic solvents such as dimethylformamide (DMF), acetone, methyl ethyl ketone, and cyclohexanone can be used.

Figure 6B:
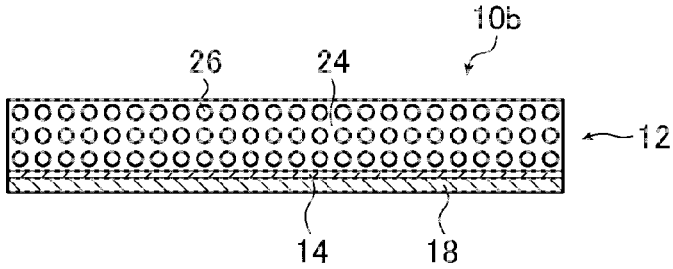

After the sheet-like substance 10*a* and the above coating material are prepared, the coating material is casted (coated) to the sheet-like substance 10*a*, and the organic solvent is evaporated to dry the resultant. In this manner, as shown in FIG. 6B, a laminate 10*b* in which the thin film electrode 14 is formed on the protective layer 18 and the piezoelectric body layer 12 is formed on the thin film electrode 14 is prepared.

The casting method of the coating material is not particularly limited, and all of the known methods (coating apparatuses) such as a slide coater or a doctor knife can be used.

Alternately, if the viscoelastic material is a material that can be melted by heating just like cyanoethylated PVA, the viscoelastic material may be melted by heating, and the piezoelectric body particles 26 may be added and dispersed into the resultant to prepare a melt. By extrusion molding or the like, the melt may be extruded in the form of sheet onto the sheet-like substance shown in FIG. 6A and then cooled, whereby the laminate 10*b* in which the thin film electrode 14 is formed on the protective layer 18 and the piezoelectric body layer 12 is formed on the thin film electrode 14 as shown in FIG. 6B may be prepared.

As described above, in the converter film 10, piezoelectric polymer materials such as PVDF and the like may be added to the viscoelastic matrix 24 in addition to the viscoelastic material such as cyanoethylated PVA.

When being added to the viscoelastic matrix 24, the polymeric piezoelectric material to be added may be dissolved in the aforementioned coating material. Alternately, the polymeric piezoelectric material to be added may be added to the viscoelastic material melted by heating, and the resultant may be melted by heating.

After the laminate 10*b* in which the thin film electrode 14 is formed on the protective layer 18 and the piezoelectric body layer 12 is formed on the thin film electrode 14 is prepared, it is preferable to perform polarization processing (polling) on the piezoelectric body layer 12.

The method of the polarization processing performed on the piezoelectric body layer 12 is not particularly limited, and the known methods can be used. Examples of preferable polarization methods include the method described in FIGS. 6C and 6D.

Figure 6C:
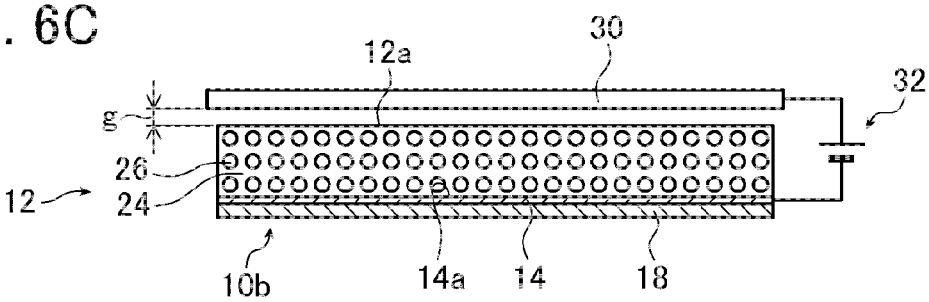
Figure 6D:
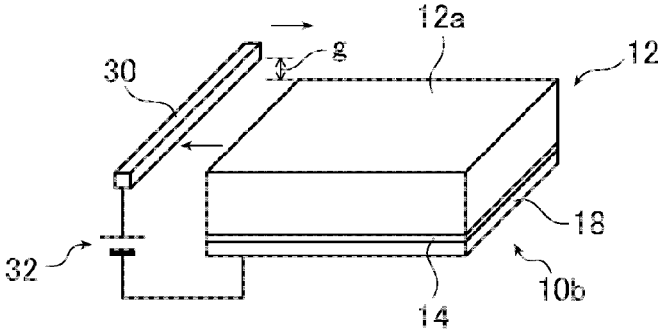

In this method, as shown in FIGS. 6C and 6D, a rod-like or wire-like movable corona electrode 30 is placed above an upper surface 12*a* of the piezoelectric body layer 12 of the laminate 10*b* along the upper surface 12*a*, in a state where there is a space g of, for example, 1 mm, between the electrode and the upper surface. Then, the corona electrode 30 and the thin film electrode 14 are connected to a DC power supply 32.

Moreover, heating means for heating and holding the laminate 10*b*, for example, a hot plate is prepared.

Thereafter, in a state where the piezoelectric body layer 12 is heated and held by the heating means at, for example, 100° C., DC voltage of several kV, for example, 6 kV, is applied between the thin film electrode 14 and the corona electrode 30 from the DC power supply 32, whereby corona discharge is caused to occur. Moreover, in a state where the space g is maintained as is, the corona electrode 30 is moved (caused to scan) along the upper surface 12*a* of the piezoelectric body layer 12 to perform polarization processing on the piezoelectric body layer 12.

In the polarization processing using corona discharge as above (hereinafter, for convenience, the processing will also be referred to as corona polling processing), the corona electrode 30 may be moved by using the known rod-like moving means.

In addition, in the corona polling processing, the method thereof is not limited to the method in which the corona electrode 30 is moved. That is, the corona electrode 30 may be fixed, and a moving mechanism for moving the laminate 10*b* may be provided to move the laminate 10*b* for performing the polarization processing. For moving the laminate 10*b*, the known sheet-like moving means may be used.

Moreover, the number of the corona electrode 30 is not limited to one, and plural corona electrodes 30 may be used for performing corona polling processing.

Furthermore, the polarization processing is not limited the corona polling processing, and it is possible to use ordinary electric field polling that directly applies direct electric field to a target to be subjected to the polarization processing. Here, for performing the ordinary electric field polling, the thin film electrode 16 needs to be formed before the polarization processing.

Before the polarization processing, calendar processing for smoothening the surface of the piezoelectric body layer 12 by using a heating roller or the like may be performed. If the calendar processing is performed, a thermocompression bonding step, which will be described later, can be smoothly conducted.

Meanwhile, a sheet-like substance 10*c* in which the thin film electrode 16 is formed on the protective layer 20 is prepared. The sheet-like substance 10*c* is similar to the aforementioned sheet-like substance 10*a*.

Figure 6E:
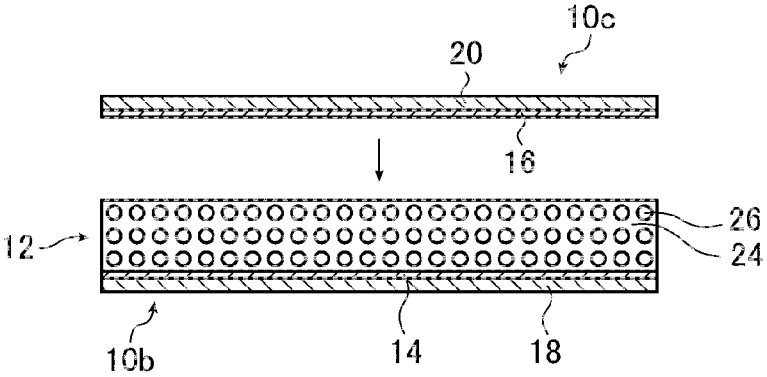

As shown in FIG. 6E, in a state where the thin film electrode 16 faces the piezoelectric body layer 12, the sheet-like substance 10*c* is laminated on the laminate 10*b* having undergone the polarization processing of the piezoelectric body layer 12.

Subsequently, the laminate of the laminate 10*b* and the sheet-like substance 10*c* is subjected to thermocompression bonding by using a heating press apparatus or a pair of heating rollers, such that the laminate is interposed between the protective layers 18 and 20. In this manner, the converter film 10 of the present invention as shown in FIG. 5 is completed.

The converter film 10 may be manufactured by using the sheet-like substance in the form of a cut sheet. However, it is preferable to use Roll to Roll (hereinafter, also referred to as RtoR) for the manufacture.

As is well known, RtoR is a manufacture method implemented as below. That is, in this method, while a raw material is being wound off from a roll, which is obtained by winding up the long raw material, and being transported in a longitudinal direction, film formation or various processing such as surface processing are performed, and then the raw material having undergone the processing is wound up again in a roll shape.

When the converter film 10 is manufactured by the aforementioned manufacture method by means of RtoR, a first roll obtained by winding up the sheet-like substance 10*a* in which the thin film electrode 14 is formed on the long protective layer 18, and a second roll obtained by winding up the sheet-like substance 10*c* in which the thin film electrode 16 is formed on the long protective layer 20 are used.

The first roll may be exactly the same as the second roll.

While being wound off from the roll and being transported in a longitudinal direction, the sheet-like substance 10*a* is coated with the aforementioned coating material containing cyanoethylated PVA and the piezoelectric body particles 26, and dried by heating or the like to form the piezoelectric body layer 12 on the thin film electrode 14, whereby the aforementioned laminate 10*b* is obtained.

Thereafter, the aforementioned corona polling is conducted to perform polarization processing on the piezoelectric body layer 12. Herein, when the converter film 10 is manufactured by RtoR, while the laminate 10*b* is being transported, the rod-like corona electrode 30, which is fixed in a state of extending in a direction orthogonal to the transport direction of the laminate 10*b*, is used to perform polarization processing on the piezoelectric body layer 12 by means of corona polling. It should be noted that as described above, calendar processing may be performed before the polarization treatment.

Subsequently, while the sheet-like substance 10*c* is being wound off from the second roll, and the sheet-like substance 10*c* and the laminate are being transported, the sheet-like substance 10*c* is laminated on the laminate 10*b* by a known method using a sticking roller or the like, in a state where the thin film electrode 16 faces the piezoelectric body layer 12 as described above.

Then the resultant is subjected to thermocompression bonding while being transported in a state where the protective layers 18 and 20 are interposed between the pair of heating rollers. In this manner, the converter film 10 is completed and then wound up in a roll shape.

In the example described above, the sheet-like substance (laminate) is transported only once in a longitudinal direction by RtoR to manufacture the converter film 10 of the present invention. However, the manufacture method is not limited thereto.

For example, after the laminate is formed, and the corona polling is performed, the laminate may be wound up once in a roll shape to form a laminate roll. Thereafter, while the laminate is being wound off from the laminate roll and being transported in a longitudinal direction, the sheet-like substance in which the thin film electrode 16 is formed on the protective layer 20 may be laminated as described above, whereby the converter film 10 may be completed and wound up in a roll shape.

The preparation of the converter film 10 is not limited to RtoR, and alternatively, the converter film 10 may be prepared by a sheet-type manufacturing method.

Next, the driving circuit 202 will be described.

The driving circuit 202 has the low pass filter 204 and the constant voltage type amplifier (constant voltage type power amplifier) 206, as illustrated in FIG. 1.

First, the driving circuit 202 performs correction of attenuating the signal intensity of the input signal from the signal source 250 at a rate of 6 dB per octave using the low pass filter 204. Then, the constant voltage type amplifier 206 amplifies the corrected input signal so as to have intensity suitable for driving the piezoelectric speaker 40, and supplies the amplified signal (applies a voltage) to the thin film electrodes 14 and 16 of the converter film 10.

Here, for the description of the signal correction in the driving circuit 202, first, characteristics of the piezoelectric speaker 40 will be described.

In the converter film 10 of the piezoelectric speaker 40, since the sheet-like diaphragm vibrates in string vibration, the sheet-like diaphragm performs bending vibration in various modes, and has resonance frequencies of the respective modes. Accordingly, the frequency characteristics of the converter film 10 have a plurality of resonance frequencies. However, the converter film 10 having the polymeric composite piezoelectric body formed by dispersing piezoelectric body particles in a viscoelastic matrix formed of a polymer material that exhibits viscoelasticity at normal temperature, which is used as the diaphragm in the present invention, has a large loss tangent Tan δ as described above, and thus, the mechanical quality factor (Q value) thereof is low. Therefore, as conceptually illustrated in FIG. 7A, peak intensity of the sound pressure level in the vicinity of each of the resonance frequencies decreases, the half width of the peak increases, and smooth frequency characteristics are obtained over the almost entire area.

Figure 7A:
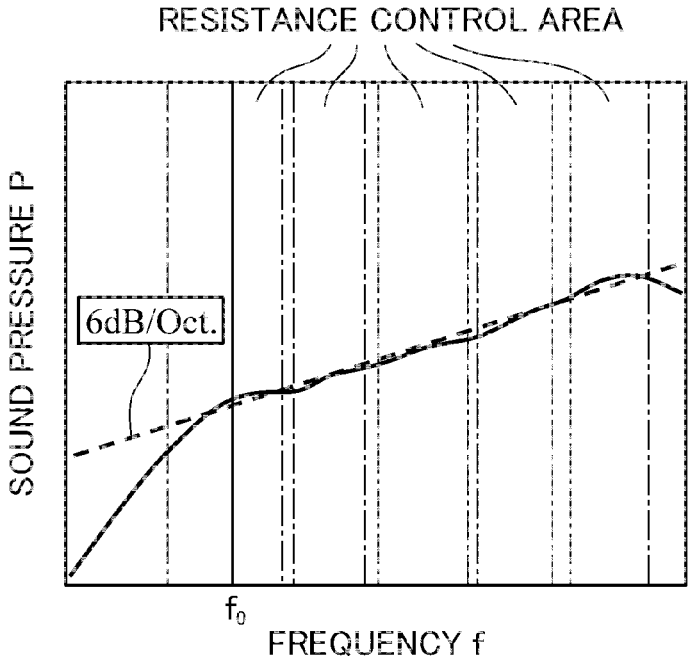
FIGS. 7A and 7B are graphs conceptually illustrating frequency characteristics of the piezoelectric speaker illustrated in FIGS. 2A to 2C.

Here, since the vicinity of the resonance frequency is the resistance control area, the almost entire area in FIG. 7A can be regarded as the resistance control area. Since speed is constant in the resistance control area, the acceleration doubles in proportion to the frequency (6 dB/octave). Since the sound pressure level is proportional to the acceleration, the frequency characteristics become frequency characteristics having a gradient of 6 dB/octave, as indicated by a dotted line in the drawing.

Figure 7B:
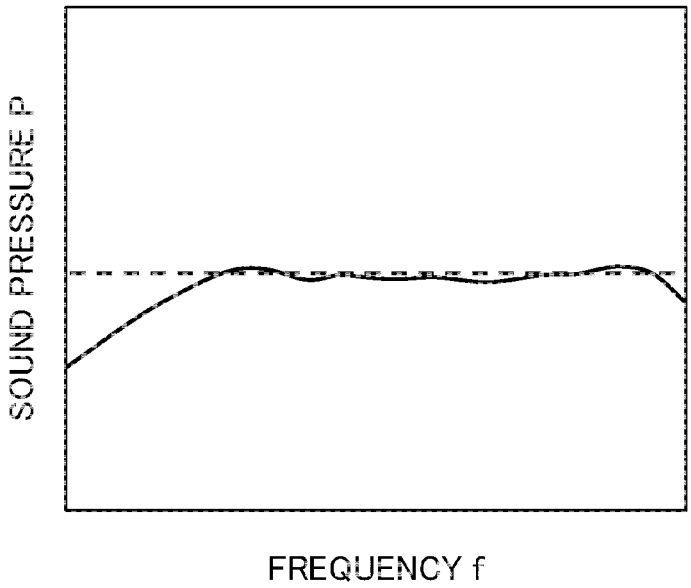

Therefore, in the present invention, the driving circuit 202 that drives the piezoelectric speaker 40 performs correction corresponding to the gradient of 6 dB/octave on the input signal from the signal source 250, thereby achieving uniform frequency characteristics in a frequency band to be used, as conceptually illustrated in FIG. 7B.

Specifically, using the low pass filter 204, the input signal is corrected such that the signal intensity of the input signal from the signal source 250 is attenuated at a rate of 6 dB per octave, and the corrected signal is supplied to the constant voltage type power amplifier 206.

The low pass filter 204 uses a frequency lower than the lowest resonance frequency of the converter film 10 as a cutoff frequency (first cutoff frequency), and attenuates the signal, of which the frequency is equal to or higher than the cutoff frequency, at a rate of 6 dB per octave.

The circuit configuration of the low pass filter 204 is not particularly limited, and various known low pass filters can be used as long as they can attenuate the signal at a rate of 6 dB per octave.

The constant voltage type power amplifier 206 amplifies the input signal having passed through the low pass filter 204 so as to have signal intensity suitable for driving the piezoelectric speaker 40, and supplies the amplified signal to the thin film electrodes 14 and 16 of the converter film 10.

Figure 8:
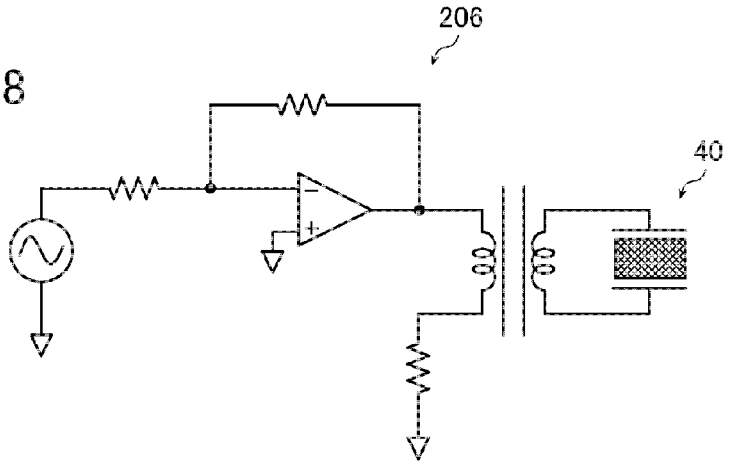
FIG. 8 is a circuit diagram of an example of a constant voltage type power amplifier in FIG. 1.

The circuit configuration of the constant voltage type power amplifier 206 is not particularly limited, and various known constant voltage type power amplifiers can be used as long as they can suitably amplify the signal. For example, a circuit using an operational amplifier and a transformer as illustrated in FIG. 8 can be used.

By using a digital signal processor (DSP) that performs digital operation processing in place of the low pass filter 204, the signal may be attenuated in a range of 5 dB to 7 dB per octave. However, since the gradient in the frequency characteristics of the converter film 10 is caused by the resistance control area, and is basically 6 dB/octave, it is preferable to attenuate the signal at a rate of 6 dB per octave.

Furthermore, the arrangement configuration of the low pass filter 204 is not limited to the configuration in which the low pass filter 204 is arranged before the constant voltage type power amplifier 206, and a configuration in which the low pass filter 204 is arranged after the constant voltage type power amplifier 206 may be adopted.

In the present embodiment, the configuration in which a frequency that is lower than the lowest resonance frequency of the converter film 10 is used as the cutoff frequency (first cutoff frequency) is adopted, but the present invention is not limited thereto. For example, when the frequency band to be used is higher than the lowest resonance frequency of the converter film 10, a frequency lower than the lower limit of the frequency band to be used may be used as the cutoff frequency, and the input signal in the frequency band to be used may be corrected.

Figure 9:
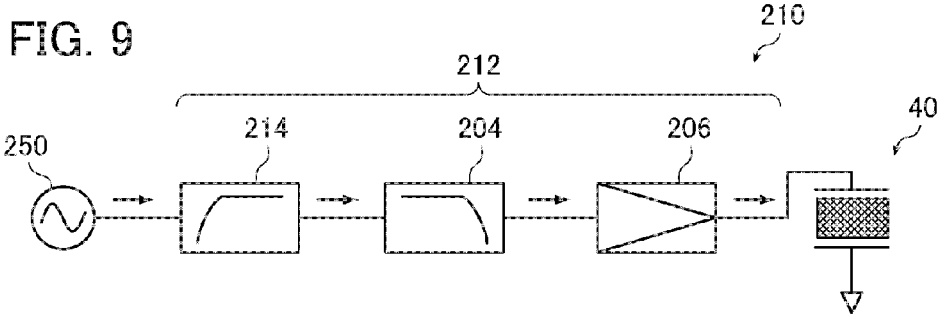
FIG. 9 is a circuit diagram conceptually illustrating another example of the speaker system of the present invention.

The driving circuit may further include a high pass filter 214, as in a speaker system 210 illustrated in FIG. 9.

The high pass filter 214 uses a frequency equal to or lower than the cutoff frequency (first cutoff frequency) of the low pass filter 204 as a cutoff frequency (second cutoff frequency), and attenuates the signal at a rate of 12 dB per octave. Accordingly, it is possible to protect the driving circuit, and it is also possible to prevent power from being consumed in a frequency band outside an audible band, thereby reducing power consumption.

The rate of the attenuation in the high pass filter 214 is not limited to 12 dB per octave, and the high pass filter 214 may be a filter that attenuates a signal at a rate of 6 dB/octave or 18 dB/octave. Further, a DSP that performs digital operation processing may be used as the high pass filter 214 to attenuate the signal at an arbitrary rate.

Furthermore, the circuit configuration of the high pass filter 214 is not particularly limited, and various known high pass filters can be used as long as they can attenuate the signal at a predetermined rate.

Even when the high pass filter 214 is included in a speaker system, the arrangement order of the low pass filter 204, the constant voltage type power amplifier 206, and the high pass filter 214 is not particularly limited, and may be changed within a scope that does not interfere with the signal processing.

The cutoff frequency (second cutoff frequency) of the high pass filter 214 is preferably a frequency equal to or lower than the cutoff frequency of the low pass filter 204. However, the cutoff frequency of the high pass filter 214 may be higher than the cutoff frequency of the low pass filter 204 to make frequency characteristics in a frequency band between the first cutoff frequency and the second cutoff frequency flat.

Figure 10:
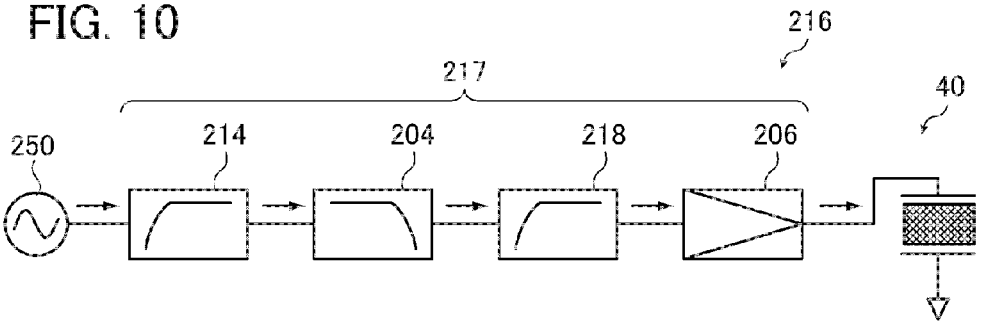
FIG. 10 is a circuit diagram conceptually illustrating another example of the speaker system of the present invention.

Alternatively, the driving circuit may further include a high pass filter 218, as in a speaker system 216 illustrated in FIG. 10.

Specifically, the driving circuit 217 of the speaker system 216 includes the low pass filter 204 that uses the first cutoff frequency lower than the lowest resonance frequency of the converter film 10 and attenuates a signal of which the frequency is equal to or higher than the first cutoff frequency; the high pass filter 214 that uses the second cutoff frequency equal to or lower than the first cutoff frequency of the low pass filter 204 and attenuates a signal of which the frequency is equal to or lower than the second cutoff frequency; a high pass filter 218 that uses a third cutoff frequency higher than the lowest resonance frequency of the converter film 10 and attenuates a signal of which the frequency is equal to or lower than the third cutoff frequency; and the constant voltage type power amplifier 206.

The rate of the attenuation in the high pass filter 218 is not particularly limited, and the high pass filter 218 may be a filter that attenuates the signal at a rate of 6 dB/octave, 12 dB/octave, or 18 dB/octave.

In an actual power amplifier, for example, a magnetic flux density of a secondary side of a boosting transformer may be saturated at the high frequency side of 10 kHz or higher, and the output may be degraded. In contrast, by increasing the signal level at the high frequency side using the high pass filter 218, it is possible to improve (uniformize) the frequency characteristics at the high frequency side.

Furthermore, in the speaker system 200 illustrated in FIG. 1, the combination of the constant voltage type power amplifier 206 and the low pass filter 204 is used as the driving circuit 202, but the present invention is not limited thereto, and a constant current type amplifier may be used as the driving circuit.

Figure 11:
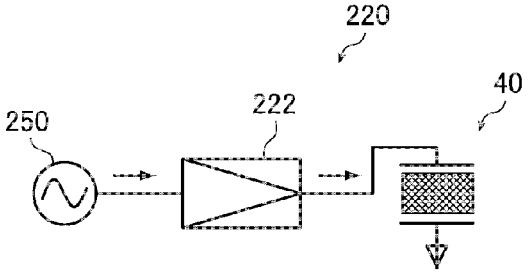
FIG. 11 is a circuit diagram conceptually illustrating another example of the speaker system of the present invention.

FIG. 11 is a circuit diagram conceptually illustrating another example of the speaker system of the present invention.

The speaker system 220 illustrated in FIG. 11 has a constant current type amplifier (constant current type power amplifier) 222 as a driving circuit, and the piezoelectric speaker 40.

Figure 12A:
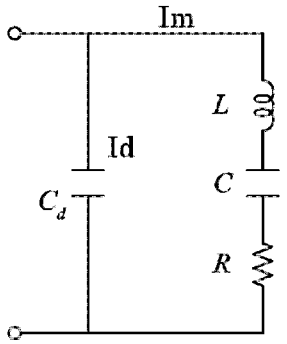
FIG. 12A is a diagram illustrating an equivalent circuit of the electroacoustic converter film illustrated in FIG. 5.
Figure 12B:
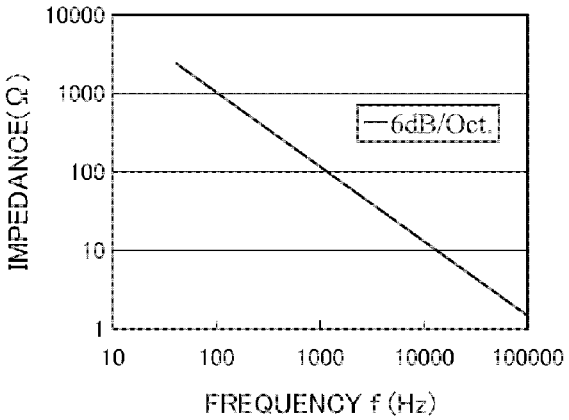
FIG. 12B is a graph illustrating frequency characteristics of electrical impedance of the equivalent circuit illustrated in FIG. 12A.

An equivalent circuit of the electroacoustic converter film is represented as a parallel circuit of an LCR serial circuit and a Cd illustrated in FIG. 12A. The frequency characteristics of electrical impedance of this equivalent circuit become a straight line falling to the right that is expressed as $1/(2\pi fCd)$, as illustrated in FIG. 12B.

That is, if the converter film 10 is driven by the constant current type power amplifier 222 that allows a constant current to flow regardless of the frequency of the input signal, a voltage proportional to a reciprocal of the frequency is applied. That is, the same driving circuit as the combination of the constant voltage type power amplifier and the low pass filter can be obtained by using the constant current type power amplifier 222.

Figure 13:
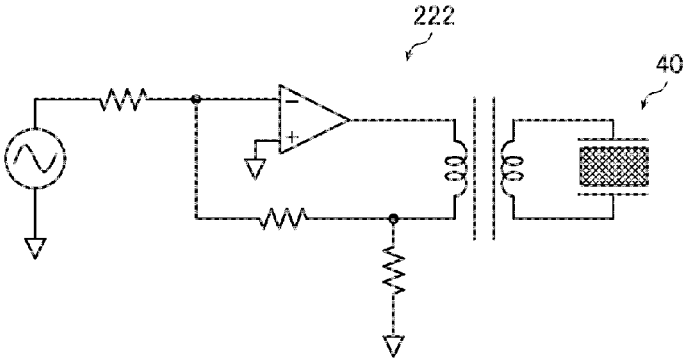
FIG. 13 is a circuit diagram of an example of a constant current type power amplifier in FIG. 11.

The circuit configuration of the constant current type power amplifier 222 is not particularly limited, and various known constant current type power amplifiers can be used as long as they can suitably amplify the signal. For example, a circuit using an operational amplifier and a transformer as illustrated in FIG. 13 can be used.

Figure 14:
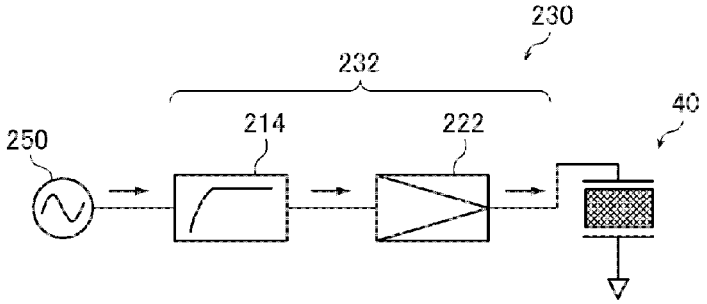
FIG. 14 is a circuit diagram conceptually illustrating another example of the speaker system of the present invention.

Furthermore, similarly to the speaker system 210, a driving circuit 232 may include a constant current type power amplifier 222 and a high pass filter 214, as in a speaker system 230 illustrated in FIG. 14.

When the constant current type power amplifier 222 is used, a very high voltage is applied at low frequencies. Therefore, it is preferable to combine the high pass filter 214 with the constant current type power amplifier 222 for the purpose of protection of the circuit and reduction of power consumption. When the constant current type power amplifier 222 and the high pass filter 214 are combined, amplification of 6 dB/octave in the constant current type power amplifier 222 is cancelled out, and thus, it is preferable to use a filter that attenuates a signal at a higher rate than the filter combined with the aforementioned constant voltage type power amplifier 206.

Moreover, the high pass filter 214 may be arranged after the constant current type power amplifier 222.

As understood from FIGS. 7A and 7B, the present invention is preferable in that, since the converter film 10 (diaphragm) has a number of resonance points, it is possible to widen the resistance control area zone and to uniformize the frequency characteristics in a wide band. Therefore, it is preferable to cause the viscoelastic support 46 to be in close contact with the converter film 10 and give an appropriate tension to the converter film 10, such that the converter film 10 can perform bending vibration in a number of different modes.

So far, the speaker system of the present invention has been described in detail, but the present invention is not limited to the above-described examples, and it is needless to say that various improvements or modifications can be made within a scope that does not depart from the gist of the present invention.

EXAMPLES

Hereinafter, the present invention will be described in more detail based on specific examples of the present invention.

First, examples of the electroacoustic converter film 10 used in the speaker system of the present invention will be described.

Example 1

By the method described above in FIGS. 6A to 6E, the converter film 10 shown in FIG. 5 was prepared.

First, in the following compositional ratio, cyanoethylated PVA (CR-V manufactured by Shin-Etsu Chemical Co., Ltd.) was dissolved in dimethylformamide (DMF). Thereafter, PZT particles were added to this solution in the following compositional ratio and dispersed by a propeller mixer (rotation frequency of 2,000 rpm), thereby preparing a coating material for forming the piezoelectric body layer 12.

| | |
|---|---|
| PZT particles | 300 parts by mass |
| Cyanoethylated PVA | 30 parts by mass |
| DMF | 70 parts by mass |

The PZT particles used were prepared by sintering commercially available PZT raw material powder at 1,000° C. to 1,200° C. and then performing pulverization and classification treatment on the resultant so as to obtain the particles having an average particle size of 5 μm.

Meanwhile, sheet-like substances 10*a* and 10*c* were prepared by vacuum-depositing a thin copper film having a thickness of 0.1 μm onto a PET film having a thickness of 4 μm. That is, in this example, the thin film electrodes 14 and 16 are copper-deposited thin films having a thickness of 0.1 μm, and the protective layers 18 and 20 are PET films having a thickness of 4 μm.

During the process, a PET film with a separator having a thickness of 50 μm (temporary support PET) was used so as to obtain good handleability. After the thin film electrodes and the protective layers were subjected to thermocompression bonding, the separator of each of the protective layers was removed.

The top of the thin film electrode 14 (copper-deposited thin film) of the sheet-like substance 10*a* was coated with the coating material for forming the piezoelectric body layer 12, which was prepared as above, by using a slide coater. The coating of the coating material was performed such that the film thickness of the dried coating film became 40 μm.

Subsequently, the sheet-like substance 10*a* of which the top had been coated with the coating material was dried by being heated on a hot plate at 120° C. to evaporate DMF. In this manner, a laminate 10*b* having the thin film electrode 14 that was disposed on the protective layer 18 made of PET and was formed of copper, and the piezoelectric body layer 12 (piezoelectric layer) that was disposed on the thin film electrode 14 and had a thickness of 40 μm was prepared.

The piezoelectric body layer 12 of the laminate 10*b* was subjected to polarization processing by means of the aforementioned corona polling illustrated in FIGS. 6C and 6D. In the polarization processing, the temperature of the piezoelectric body layer 12 was controlled to be 100° C., and DC voltage of 6 kV was applied between the thin film electrode 14 and the corona electrode 30 to cause corona discharge.

On the laminate 10*b* having undergone the polarization processing, the sheet-like substance 10*c* was laminated, in a state where the thin film electrode 16 (thin copper film side) faced the piezoelectric body layer 12.

Then, the laminate of the laminate 10*b* and the sheet-like substance 10*c* was subjected to thermocompression bonding at 120° C. by using a laminator apparatus, such that the piezoelectric body layer 12 was stuck to the thin film electrodes 14 and 16, whereby the converter film 10 was prepared.

[Flexibility Test]

From the prepared converter film 10, a strip specimen of 1 cm×15 cm was prepared.

The specimen was bent to yield a predetermined radius of curvature (r=5 cm, r=2.5 cm, and r=0.5 cm) and allowed to recover their original state. This operation was repeated 10 times, and then the electric characteristics (capacitance and dielectric loss) and change in the exterior thereof were investigated.

When the specimen did not exhibit change in the electric characteristics and the exterior, it was marked with A. When the specimen did not exhibit change in the electric characteristics but had a mark such as a crease, it was marked with B. When a test piece exhibited change in the electric characteristics, it was marked with C.

The results are shown in Table 1.

[Dynamic Viscoelasticity Test]

From the prepared converter film 10, a strip specimen of 1 cm×4 cm was prepared.

The dynamic viscoelasticity (storage modulus E' (GPa) and loss tangent Tan δ) of the specimen was measured using a dynamic viscoelasticity tester (DMS6100 viscoelasticity spectrometer manufactured by SII NanoTechnology Inc.). The measurement was performed under the following conditions.

Range of measurement temperature: −20° C. to 100° C.

Rate of temperature increase: 2° C./min

Figure 15A:
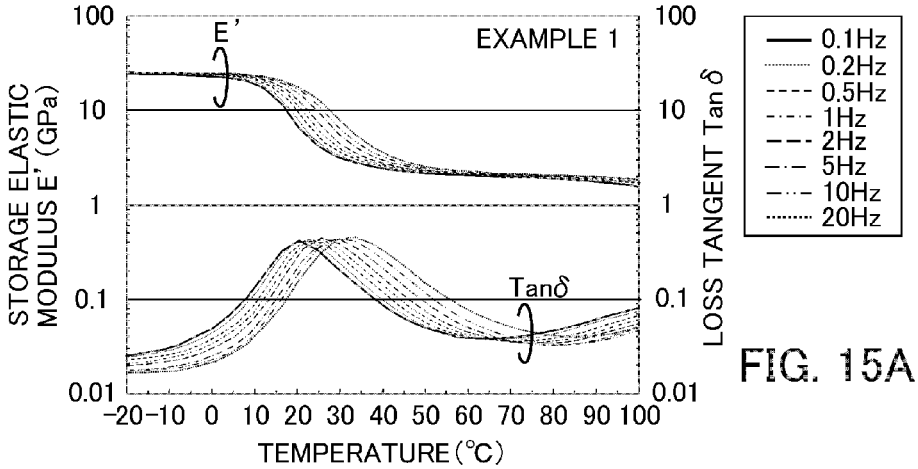
FIGS. 15A to 15C are diagrams illustrating temperature dependence of dynamic viscoelasticity in the electroacoustic converter film used in the present invention and a comparative material.

Measurement frequency: 0.1 Hz, 0.2 Hz, 0.5 Hz, 1.0 Hz, 2.0 Hz, 5.0 Hz, 10 Hz, and 20 Hz Measurement mode: tensile measurement The temperature dependence of dynamic viscoelasticity is shown in FIG. 15A and Table 1. In addition, the result measured at 1 Hz is also described in FIG. 18A.

Figure 20:
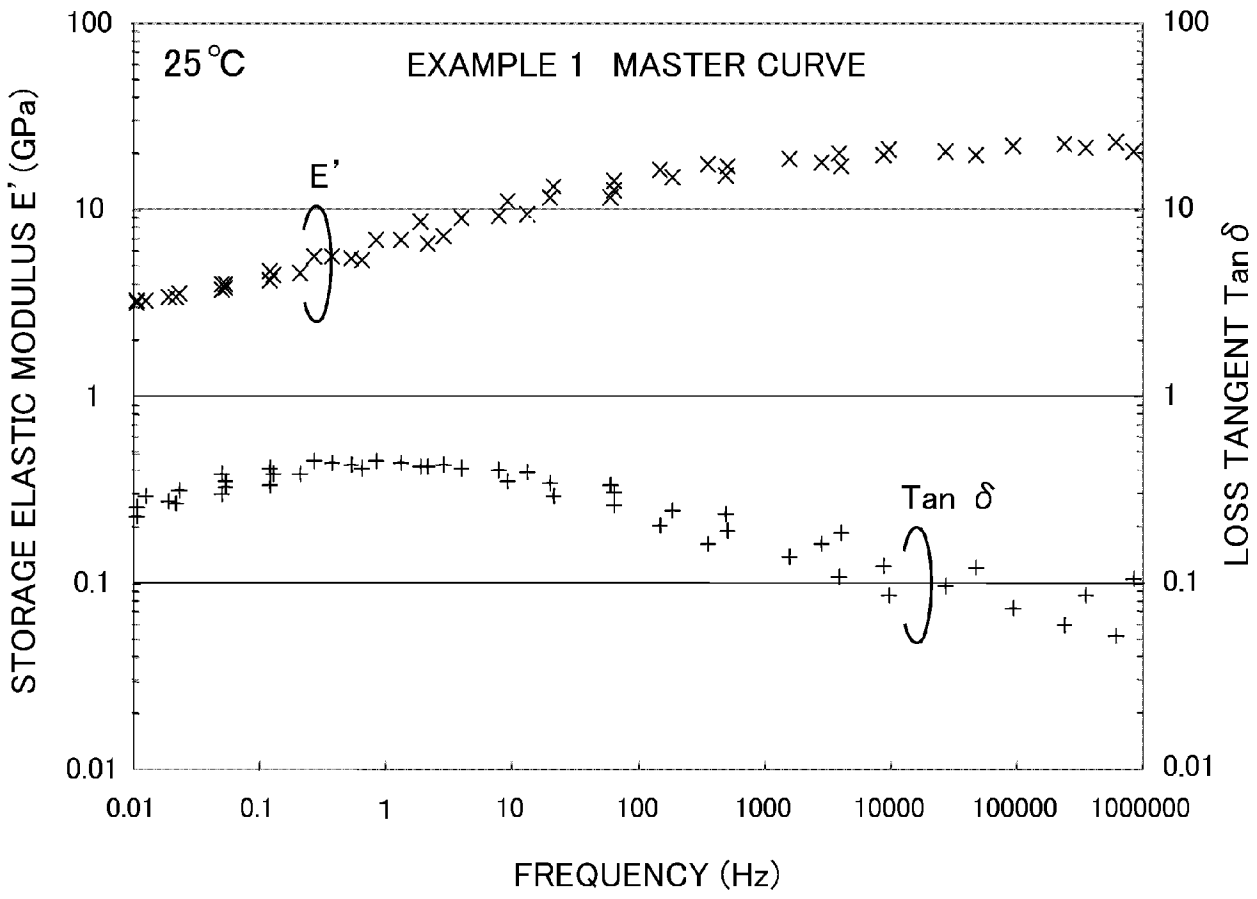
FIG. 20 is a diagram illustrating a master curve obtained from dynamic viscoelasticity measurement of the electroacoustic converter film used in the present invention.

Moreover, a master curve at a standard temperature of 25° C. that was obtained by dynamic viscoelasticity measurement is shown in FIG. 20.

Generally, between the frequency and temperature in the results of the dynamic viscoelasticity measurement, a certain relationship based on "time-temperature reduction law" is established. For example, it is possible to convert the change in temperature into the change in frequency to investigate frequency dispersion of viscoelastic characteristics at a certain temperature. The curve plotted at this time is called a master curve. It is impractical to perform viscoelasticity measurement in an actual audio band, for example, an audio band at 1 kHz. Accordingly, in grasping storage modulus E' or loss tangent Tan δ of a material in an audio band, a master curve is effective.

The storage modulus E' and loss tangent Tan δ for each frequency that were obtained from the master curve (FIG. 20) at a standard temperature of 25° C. are described in Table 2.

Herein, Table 2 also describes a sound velocity v for each frequency that is calculated by the following equation. In the equation, ρ is a specific gravity, and E is a Young's modulus (corresponding to the storage modulus E').

Sound velocity: $V$ [Equation 1]

$$V = \sqrt{\frac{E}{\rho}}$$

Table 2 also describes a Young's modulus (corresponding to the storage modulus E'), an internal loss (corresponding to the loss tangent Tan δ), a specific gravity, and a sound velocity of a cone paper that is widely used as a speaker.

Figure 16A:
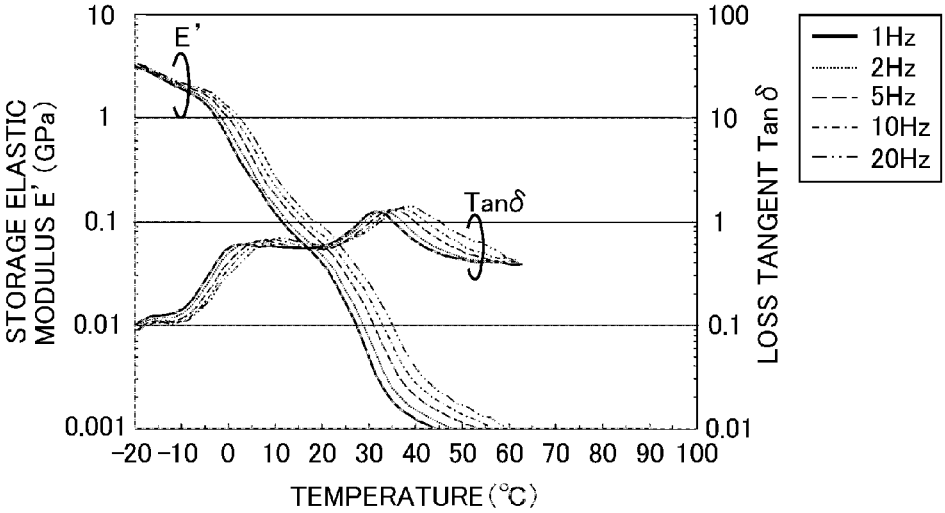
FIGS. 16A and 16B are diagrams illustrating temperature dependence of dynamic viscoelasticity of a single polymer material used as a matrix of the electroacoustic converter film used in the present invention and a comparative material.

In addition, the temperature dependence of the dynamic viscoelasticity of a single cyanoethylated PVA used for the matrix of the electroacoustic converter film is shown in FIG. 16A.

[Speaker Performance Test]

From the prepared converter film 10, a circular specimen of ϕ150 mm was prepared.

By using this test piece, the piezoelectric speaker 56 illustrated in FIG. 4C was prepared. As the case 42, a circular container made of plastic having an inner diameter of 138 mm and a depth of 9 mm was used. The internal pressure of the case 42 was maintained at 1.02 atm. In this manner, the converter film 10 was bent to become a convex shape just like contact lens.

The sound pressure level-frequency characteristics of the thin piezoelectric speaker prepared as above were measured by sine wave sweep measurement using a constant current type power amplifier. A microphone for the measurement was placed at a position of 10 cm right above the center of the piezoelectric speaker 56.

Figure 17:
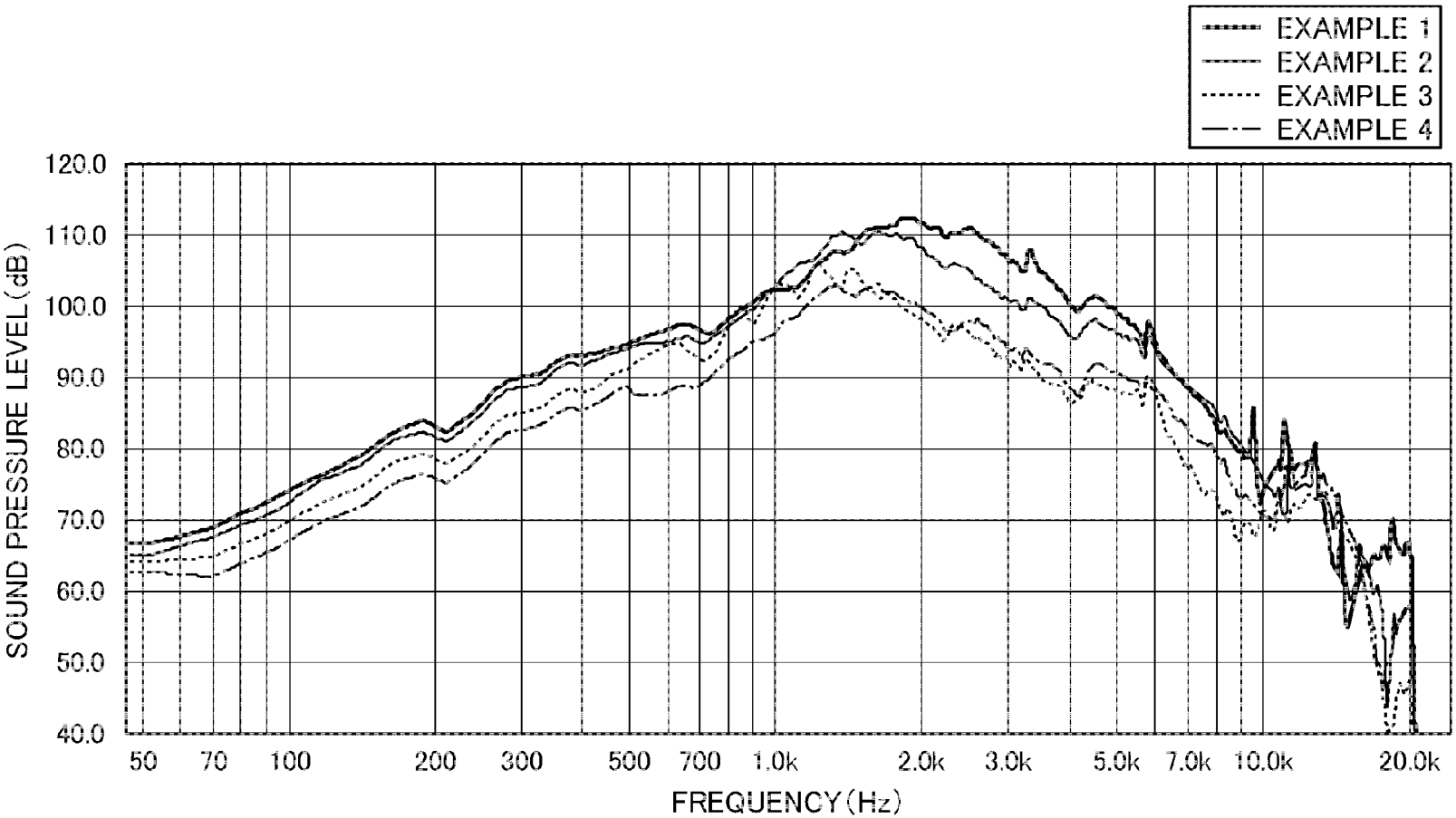
FIG. 17 is a diagram illustrating an influence of a thickness of a protective layer on speaker performance of the electroacoustic converter film used in the present invention.

The measurement results of the sound pressure level-frequency characteristics are shown in FIG. 17.

Example 2

The converter film 10 was prepared in the completely same manner as in Example 1, except that the sheet-like substances 10*a* and 10*c*, which was obtained by vacuum-depositing a thin copper film having a thickness of 0.1 μm onto a PET film having a thickness of 12 μm, were used.

That is, in this example, the thin film electrodes 14 and 16 are copper-deposited thin films having a thickness of 0.1 μm, and the protective layers 18 and 20 are PET films having a thickness of 12 μm. The thickness of the piezoelectric body layer 12 was 45 μm.

Regarding the converter film 10 prepared in this manner, the flexibility test, dynamic viscoelasticity test, and speaker performance test were performed in the same manner as in Example 1.

Figure 18A:
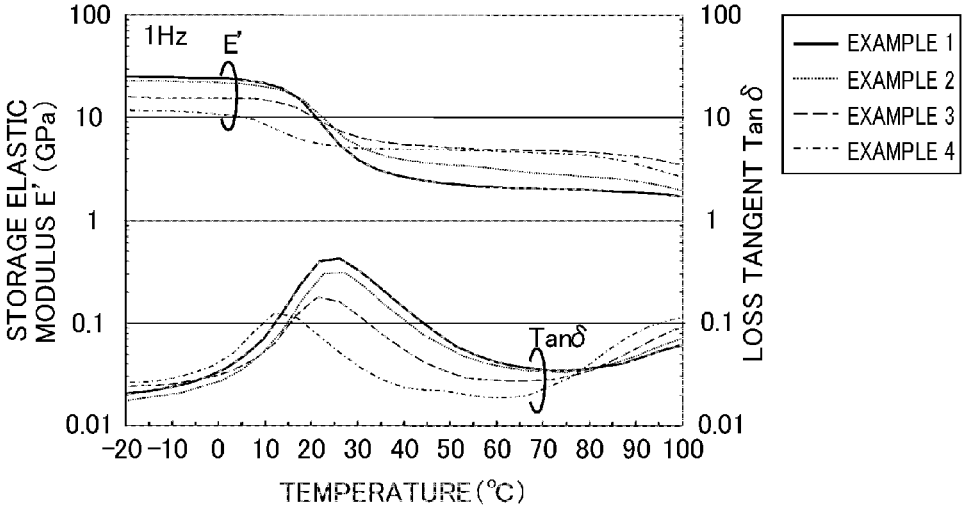
FIGS. 18A and 18B are diagrams illustrating the influence of a thickness of the protective layer and a thin film electrode on dynamic viscoelastic characteristics of the electroacoustic converter film used in the present invention.

The results of the flexibility test are shown in Table 1, the temperature dependence of the dynamic viscoelasticity at 1 Hz is shown in FIG. 18A and Table 1, and the measurement result of the sound pressure level-frequency characteristics is shown in FIG. 17.

Example 3

The converter film 10 was prepared in the completely same manner as in Example 1, except that the sheet-like substances 10*a* and 10*c*, which were obtained by vacuum-depositing a thin copper film having a thickness of 0.1 μm onto a PET film having a thickness of 25 μm, were used. That is, in this example, the thin film electrodes 14 and 16 are copper-deposited thin films having a thickness of 0.1 μm, and the protective layers 18 and 20 are PET films having a thickness of 25 μm.

Regarding the converter film 10 prepared in this manner, the flexibility test, dynamic viscoelasticity test, and speaker performance test were performed in the same manner as in Example 1.

Figure 18B:
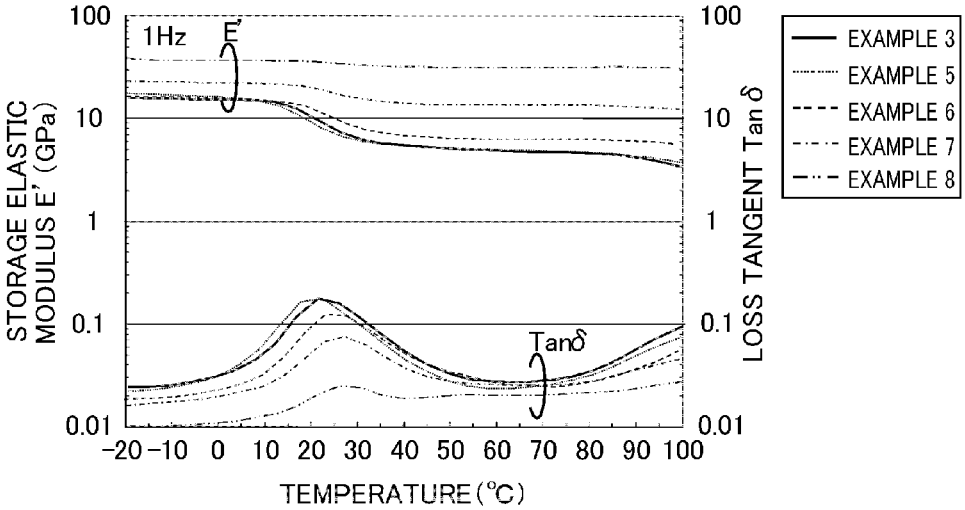
Figure 19:
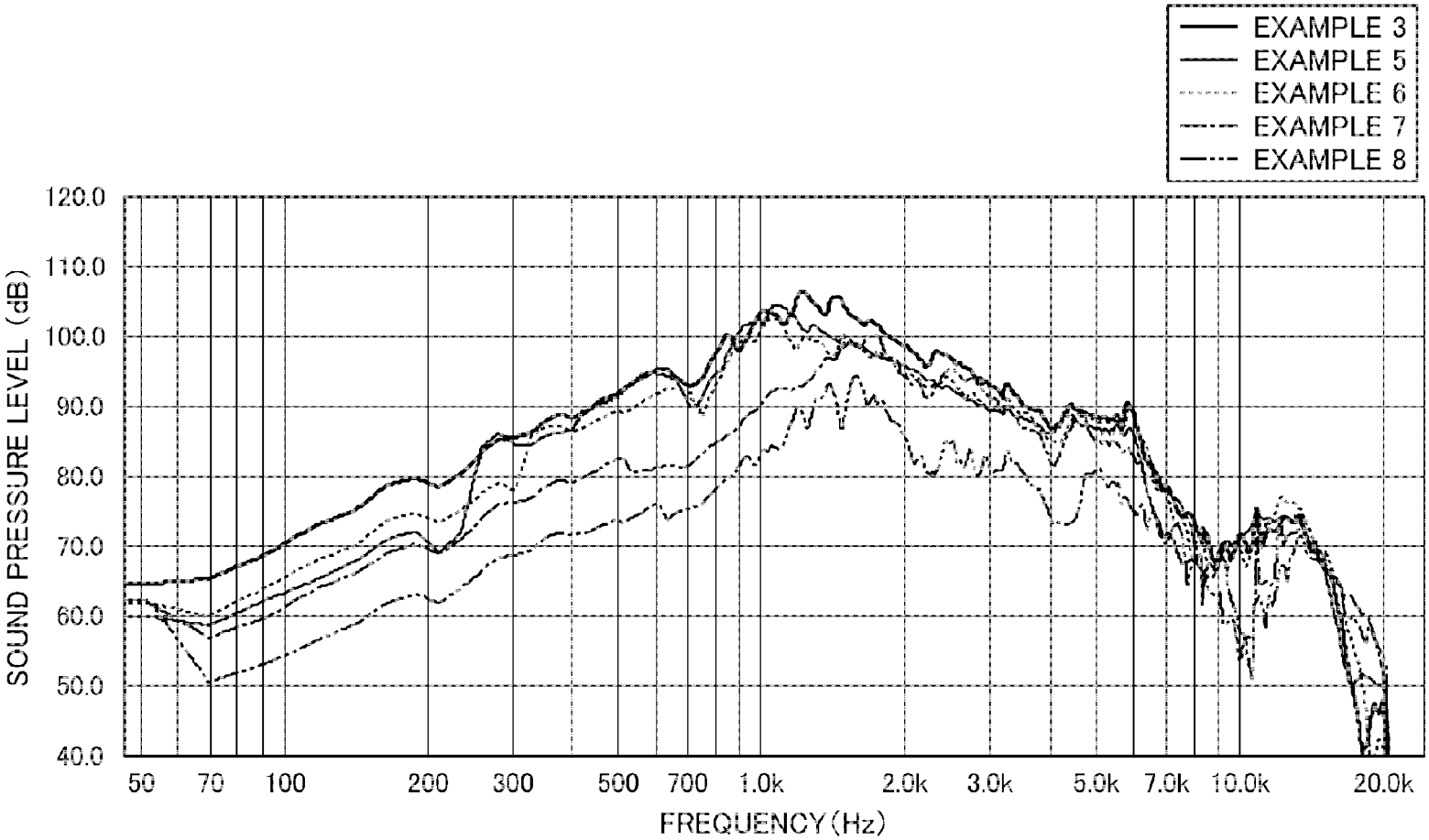
FIG. 19 is a diagram illustrating the influence of a thickness of the thin film electrode on speaker performance of the electroacoustic converter film used in the present invention.

The results of the flexibility test are shown in Table 1, the temperature dependence of the dynamic viscoelasticity at 1 Hz is shown in FIG. 18A and Table 1, and the measurement result of the sound pressure level-frequency characteristics is shown in FIG. 17. The temperature dependence of the dynamic viscoelasticity is also shown in FIG. 18B, and the sound pressure level-frequency characteristics are also shown in FIG. 19.

Example 4

The converter film 10 was prepared in the completely same manner as in Example 1, except that the sheet-like substances 10*a* and 10*c*, which were obtained by vacuum-depositing a thin copper film having a thickness of 0.1 μm onto a PET film having a thickness of 50 μm, were used. That is, in this example, the thin film electrodes 14 and 16 are copper-deposited thin films having a thickness of 0.1 μm, and the protective layers 18 and 20 are PET films having a thickness of 50 μm. The thickness of the piezoelectric body layer 12 was 42 μm.

Regarding the converter film 10 prepared in this manner, the flexibility test, dynamic viscoelasticity test, and speaker performance test were performed in the same manner as in Example 1.

The results of the flexibility test are shown in Table 1, the temperature dependence of the dynamic viscoelasticity at 1 Hz is shown in FIG. 18A and Table 1, and the measurement result of the sound pressure level-frequency characteristics is shown in FIG. 17.

Example 5

The converter film 10 was prepared in the completely same manner as in Example 1, except that the sheet-like substances 10*a* and 10*c*, which were obtained by vacuum-depositing a thin copper film having a thickness of 0.3 μm onto a PET film having a thickness of 25 μm, were used. That is, in this example, the thin film electrodes 14 and 16 are copper-deposited thin films having a thickness of 0.3 μm, and the protective layers 18 and 20 are PET films having a thickness of 25 μm.

Regarding the converter film 10 prepared in this manner, the flexibility test, dynamic viscoelasticity test, and speaker performance test were performed in the same manner as in Example 1.

The results of the flexibility test are shown in Table 1, the temperature dependence of the dynamic viscoelasticity at 1 Hz is shown in FIG. 18B and Table 1, and the measurement result of the sound pressure level-frequency characteristics is shown in FIG. 19.

Example 6

The converter film 10 was prepared in the completely same manner as in Example 1, except that the sheet-like substances 10*a* and 10*c*, which were obtained by vacuum-depositing a thin copper film having a thickness of 1.0 μm onto a PET film having a thickness of 25 μm, were used. That is, in this example, the thin film electrodes 14 and 16 are copper-deposited thin films having a thickness of 1.0 μm, and the protective layers 18 and 20 are PET films having a thickness of 25 μm. The thickness of the piezoelectric body layer 12 was 41 μm.

Regarding the converter film 10 prepared in this manner, the flexibility test, dynamic viscoelasticity test, and speaker performance test were performed in the same manner as in Example 1.

The results of the flexibility test are shown in Table 1, the temperature dependence of the dynamic viscoelasticity at 1 Hz is shown in FIG. 18B and Table 1, and the measurement result of the sound pressure level-frequency characteristics is shown in FIG. 19.

Example 7

The converter film 10 was prepared in the completely same manner as in Example 1, except that the sheet-like substances 10*a* and 10*c*, which were obtained by forming a thin copper film having a thickness of 3.0 μm on a PET film having a thickness of 25 μm by means of plating, were used. That is, in this example, the thin film electrodes 14 and 16 are copper-plated films having a thickness of 3.0 μm, and the protective layers 18 and 20 are PET films having a thickness of 25 μm. The thickness of the piezoelectric body layer 12 was 44 μm.

Regarding the converter film 10 prepared in this manner, the flexibility test, dynamic viscoelasticity test, and speaker performance test were performed in the same manner as in Example 1.

The results of the flexibility test are shown in Table 1, the temperature dependence of the dynamic viscoelasticity at 1 Hz is shown in FIG. 18B and Table 1, and the measurement result of the sound pressure level-frequency characteristics is shown in FIG. 19.

Example 8

The converter film 10 was prepared in the completely same manner as in Example 1, except that the sheet-like substances 10*a* and 10*c*, which were obtained by forming a thin copper film having a thickness of 10.0 μm on a PET film having a thickness of 25 μm by means of plating, were used. That is, in this example, the thin film electrodes 14 and 16 are copper-plated films having a thickness of 10.0 μm, and the protective layers 18 and 20 are PET films having a thickness of 25 μm. The thickness of the piezoelectric body layer 12 was 50 μm.

Regarding the converter film 10 prepared in this manner, the flexibility test, dynamic viscoelasticity test, and speaker performance test were performed in the same manner as in Example 1.

The results of the flexibility test are shown in Table 1, the temperature dependence of the dynamic viscoelasticity at 1 Hz is shown in FIG. 18B and Table 1, and the measurement result of the sound pressure level-frequency characteristics is shown in FIG. 19.

Comparative Example 1

An electroacoustic converter film was prepared in the same manner as in Example 1, except that cyanoethylated pullulan not exhibiting viscoelasticity at normal temperature was used as a polymer matrix. That is, in this example, the thin film electrodes 14 and 16 are copper-deposited thin films having a thickness of 0.1 μm, and the protective layers 18 and 20 are PET films having a thickness of 4 μm. The thickness of the piezoelectric body layer was 42 μm.

Regarding the electroacoustic converter film prepared in this manner, the flexibility test, and dynamic viscoelasticity test were performed in the same manner as in Example 1.

Figure 15B:
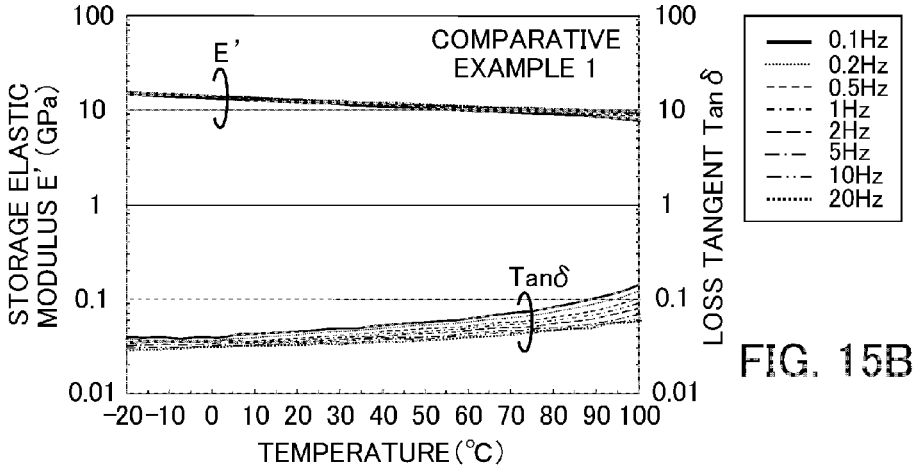

The results of the flexibility test are shown in Table 1, and the temperature dependence of the dynamic viscoelasticity is shown in FIG. 15B and Table 1.

Unlike in Example 1, in Comparative example 1, frequency dispersion was practically not observed in the storage modulus E' at a temperature around normal temperature. Therefore, the storage modulus E' and loss tangent Tan δ at 25° C. and 20 Hz were described as representative values in Table 2, and the sound velocity v was calculated from the specific gravity and the storage modulus E'.

Figure 16B:
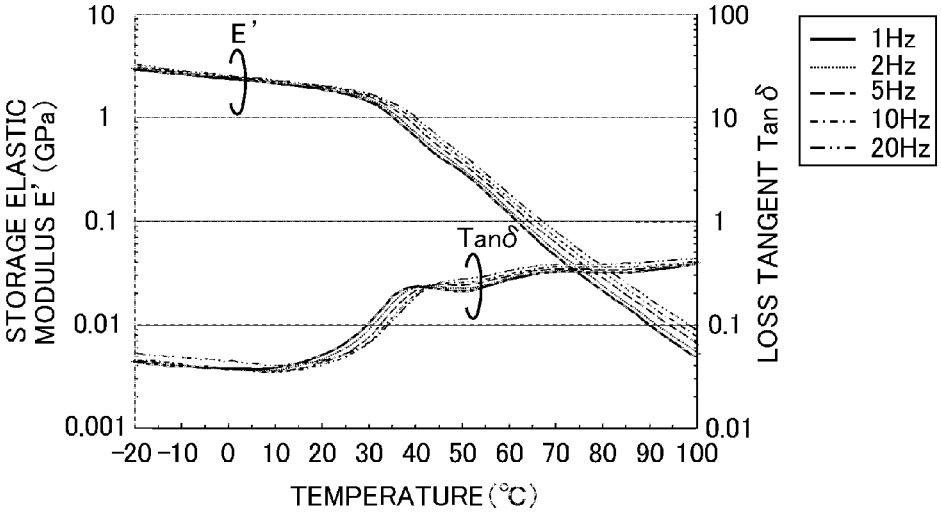

Moreover, FIG. 16B shows the temperature dependence of the dynamic viscoelasticity of a single cyanoethylated pullulan used as the matrix of the electroacoustic converter film.

Comparative Example 2

A piezoelectric film having a thickness of 56 μm and formed of PVDF was prepared.

A copper-deposited thin film having a thickness of 0.1 μm was formed at both sides of the piezoelectric film to prepare an electroacoustic converter film.

Regarding the electroacoustic converter film prepared in this manner, the flexibility test and the dynamic viscoelasticity test were performed in the same manner as in Example 1. The speaker performance test was performed using a rectangular specimen of 20 cm×15 cm prepared for the test. At that time, the specimen was prepared so that the longitudinal direction of the specimen and the polarization direction (stretching direction) of the piezoelectric film formed of PVDF were parallel to each other. The specimen was curved in the longitudinal direction and the sound pressure level-frequency characteristics thereof were measured as in Example 1.

Figure 15C:
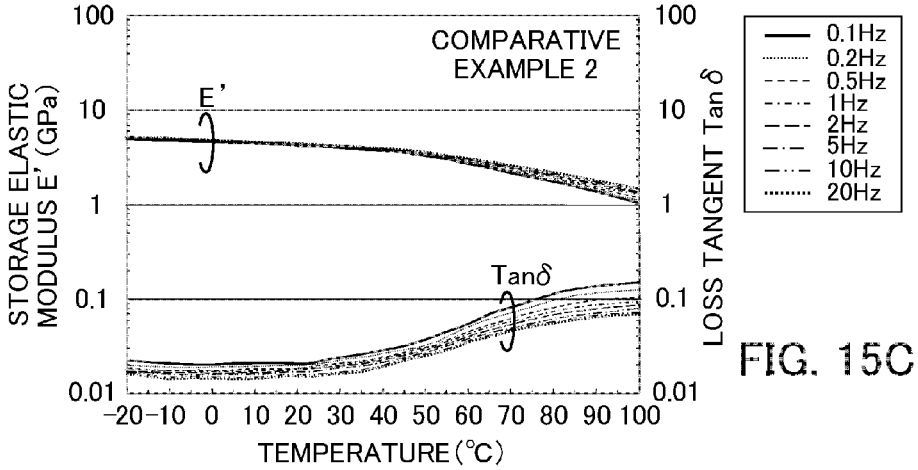

The results of the flexibility test are shown in Table 1, and the temperature dependence of the dynamic viscoelasticity is shown in FIG. 15C and Table 1.

Unlike in Example 1, also in Comparative example 2, frequency dispersion was practically not observed in the storage modulus E' at a temperature around normal temperature. Therefore, the storage modulus E' and loss tangent Tan δ at 25° C. and 20 Hz were described as representative values in Table 2, and the sound velocity v was calculated from the specific gravity and the storage modulus E'.

TABLE 1

| | | Ex. 1 | Ex. 2 | Ex. 3 | Ex. 4 | Ex. 5 | Ex. 6 | Ex. 7 | Ex. 8 | Comp. Ex. 1 | Comp. Ex. 2 PVDF |
|---|---|---|---|---|---|---|---|---|---|---|---|
| | | Polymeric composite piezoelectric body | | | | | | | | | |
| Thickness (μm) | Piezoelectric layer | 40 | 45 | 40 | 42 | 40 | 41 | 44 | 50 | 42 | 56 |
| | Protective layer | 4 | 12 | 25 | 50 | 25 | 25 | 25 | 25 | 4 | None |
| | Electrode layer | 0.1 | 0.1 | 0.1 | 0.1 | 0.3 | 1 | 3 | 10 | 0.1 | 0.1 |
| | Total | 48 | 69 | 90 | 142 | 91 | 93 | 100 | 120 | 50 | 56 |
| Flexibility | r = 5 cm | A | A | A | A | A | A | A | A | C | A |
| | r = 2.5 cm | A | A | A | A | A | A | A | B | C | A |
| | r = 0.5 cm | A | A | A | B | A | A | B | B | C | A |
| Loss tangent | 1 Hz, 0° C. | 0.036 | 0.028 | 0.030 | 0.039 | 0.032 | 0.023 | 0.020 | 0.011 | 0.035 | 0.017 |
| | 1 Hz, 25° C. | 0.430 | 0.307 | 0.160 | 0.050 | 0.130 | 0.125 | 0.075 | 0.025 | 0.038 | 0.017 |
| | 1 Hz, 50° C. | 0.061 | 0.050 | 0.034 | 0.022 | 0.028 | 0.034 | 0.028 | 0.020 | 0.045 | 0.024 |
| Storage modulus (GPa) | 1 Hz, 0° C. | 24.1 | 21.9 | 15.6 | 11.0 | 16.4 | 15.9 | 22.5 | 37.2 | 13.8 | 5.1 |
| | 1 Hz, 25° C. | 5.5 | 6.4 | 7.4 | 5.3 | 6.6 | 11.1 | 16.7 | 34.5 | 12.3 | 4.6 |
| | 1 Hz, 50° C. | 2.2 | 3.4 | 5.2 | 4.9 | 5.2 | 6.5 | 13.8 | 31.6 | 10.9 | 3.8 |
| Thickness × Storage modulus (N/m) | 1 Hz, 0° C. | 1.2E+06 | 1.5E+06 | 1.4E+06 | 1.6E+06 | 1.5E+06 | 1.5E+06 | 2.2E+06 | 4.5E+06 | 6.9E+05 | 2.6E+05 |
| | 1 Hz, 25° C. | 2.6E+05 | 4.4E+05 | 6.7E+05 | 7.5E+05 | 6.0E+05 | 1.0E+06 | 1.7E+06 | 4.1E+06 | 6.1E+05 | 2.3E+05 |
| | 1 Hz, 50° C. | 1.1E+05 | 2.4E+05 | 4.7E+05 | 6.9E+05 | 4.7E+05 | 6.0E+05 | 1.4E+06 | 3.8E+06 | 5.5E+05 | 1.9E+05 |

TABLE 2

| | Cone paper | Ex. 1 0.01 Hz | 0.1 Hz | 1 Hz | 10 Hz | 100 Hz | 1 kHz | 10 kHz | 100 kHz | 1 MHz | Comp. Ex. 1 | Comp. Ex. 2 |
|---|---|---|---|---|---|---|---|---|---|---|---|---|
| Storage modulus (GPa) | 1.45 | 3.2 | 4.0 | 5.5 | 11.2 | 16.1 | 18.8 | 20.7 | 21.8 | 22.1 | 12.8 | 5 |
| Specific gravity (g/cm$^3$) | 0.4 | 4.6 | 4.6 | 4.6 | 4.6 | 4.6 | 4.6 | 4.6 | 4.6 | 4.6 | 4.6 | 1.8 |
| Sound velocity (m/sec) | 1904 | 834 | 933 | 1093 | 1560 | 1871 | 2022 | 2121 | 2177 | 2192 | 1668 | 1667 |
| Loss tangent | 0.035 | 0.256 | 0.339 | 0.430 | 0.352 | 0.206 | 0.139 | 0.086 | 0.074 | 0.069 | 0.034 | 0.018 |

From Table 1, it is understood that Examples 1 to 8, which use cyanoethylated PVA exhibiting viscoelasticity at normal temperature as a matrix, have flexibility extremely superior to that of Comparative example 1 which uses cyanoethylated pullulan not having viscoelasticity as a matrix. However, if the electrode layer is too thick, the flexibility greatly deteriorates.

From Table 1, it is also understood that if a product of the thickness of the converter film 10 and the storage modulus (E') at a frequency of 1 Hz of the converter film 10 that is obtained by dynamic viscoelasticity measurement is $1.0\times10^6$ N/m to $2.0\times10^6$ N/m at 0° C. and $1.0\times10^5$ N/m to $1.0\times10^6$ N/m at 50° C., appropriate rigidity and mechanical strength are obtained within a range that does not impair the flexibility.

Moreover, in FIG. 18, as the thickness of the protective layer and the electrode increases, the value of the storage modulus (E') of the converter film 10 becomes close to the elastic modulus of the protective layer and the electrode, and the value of the loss tangent (Tan δ) decreases. From this fact, it is understood that the viscoelasticity characteristics of the converter film 10 are mainly influenced by the protective layer and the electrode.

That is, it is considered that the reason why the sound pressure level decreases as the thickness of the protective layer and the electrode increases in FIGS. 17 and 19 is that the expansion and contraction of the converter film 10 are decreased by the restriction due to the protective layer and the electrode.

The above fact shows that it is preferable that the material or thickness of the protective layer and the electrode in the converter film 10 used in the present invention be adjusted according to the requirements of the energy efficiency, flexibility and mechanical strength, which will vary with the use.

Moreover, it is also understood from Table 2 that the converter film 10 used in the present invention has characteristics in which the sound velocity becomes equal to or higher than that of cone paper at a frequency of an audio band of 20 Hz to 20 kHz, and as the frequency is heightened, the sound velocity increases.

Next, examples of the speaker system of the present invention will be described.

Example 9

The speaker system 220 using a constant current type power amplifier illustrated in FIG. 11 was prepared.

The piezoelectric speaker illustrated in FIG. 4C was prepared as the piezoelectric speaker 40.

The converter film of Example 1 was used as the converter film 10, and a rectangular specimen having a vibration surface of 210×300 mm plus a margin was prepared.

In the case 42, the inner size of the cylinder was 210×300 mm (A4 size), and the depth of the case 42 was 9 mm.

The internal pressure of the case 42 was maintained at 1 atm.

The driving circuit was a constant current type power amplifier. The input signal from the signal source 250 was attenuated at a rate of 6 dB/octave, and an output voltage was applied.

The sound pressure level-frequency characteristics of the thin piezoelectric speaker prepared as above were measured by sine wave sweep measurement. The microphone for measurement was placed at a position of 50 cm right above the center of the piezoelectric speaker 56.

Figure 21A:
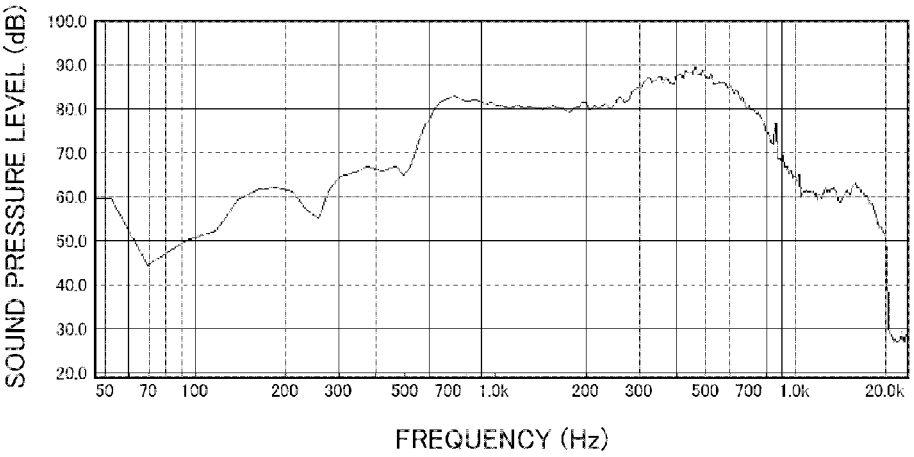
FIGS. 21A and 21B are diagrams illustrating frequency characteristics of the speaker system of the present invention.

The measurement result of the sound pressure level-frequency characteristics is shown in FIG. 21A.

Figure 21B:
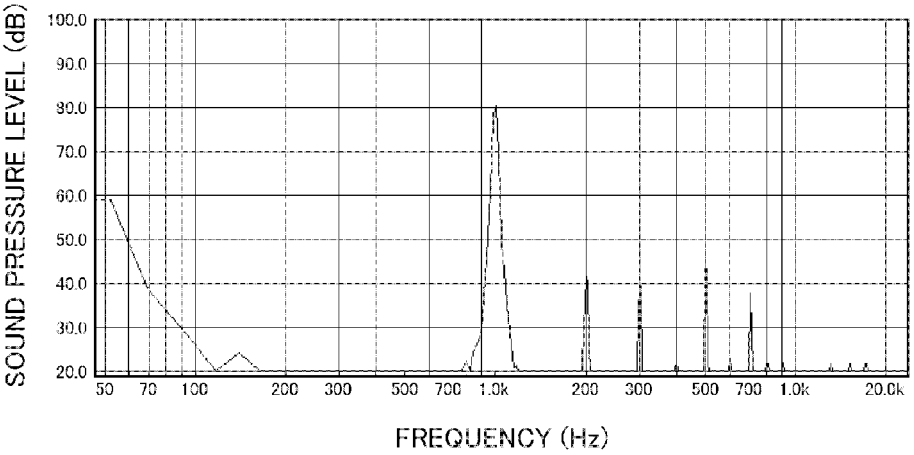

Further, the measurement result of the sound pressure level-frequency characteristics when a sine wave at 1 kHz was input is shown in FIG. 21B.

Example 10

The sound pressure level-frequency characteristics were measured in the same manner as in Example 9, except that the internal pressure of the case 42 was maintained at 1.01 atm.

Figure 22A:
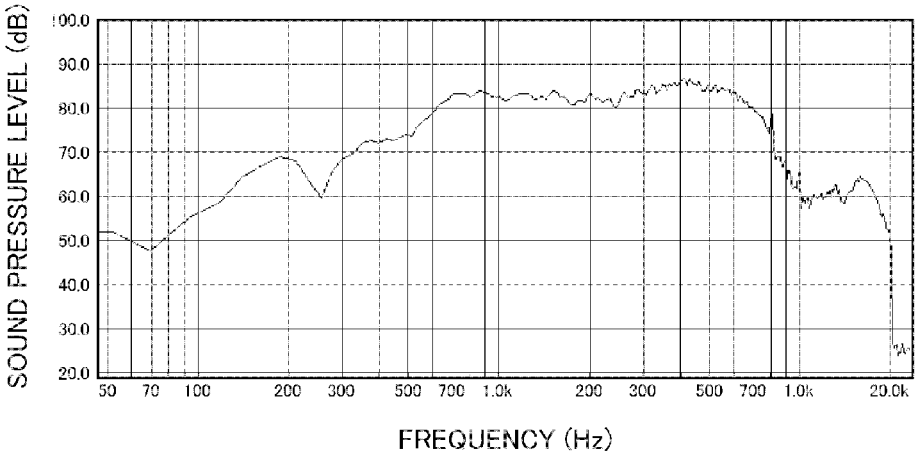
FIGS. 22A and 22B are diagrams illustrating frequency characteristics of the speaker system of the present invention.
Figure 22B:
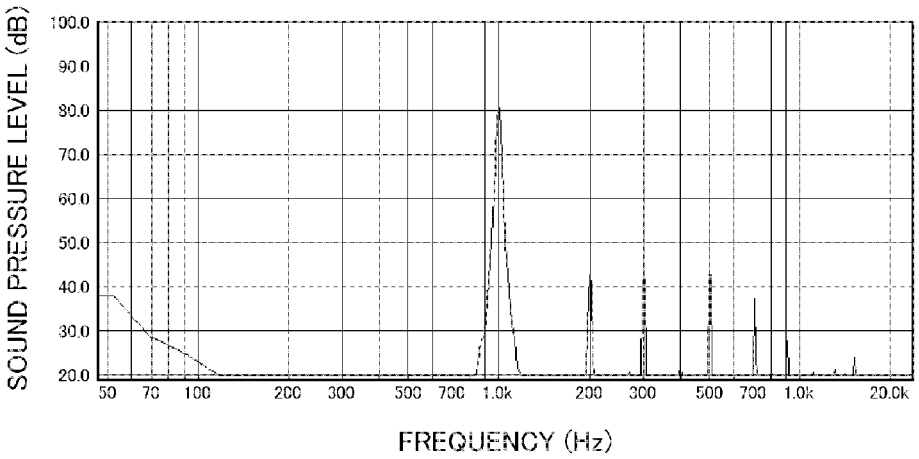

The measurement result of the sine wave sweep measurement is shown in FIG. 22A, and the measurement result when a sine wave at 1 kHz was input is shown in FIG. 22B.

Example 11

The sound pressure level-frequency characteristics were measured in the same manner as in Example 9, except that the internal pressure of the case 42 was maintained at 1.02 atm.

Figure 23A:
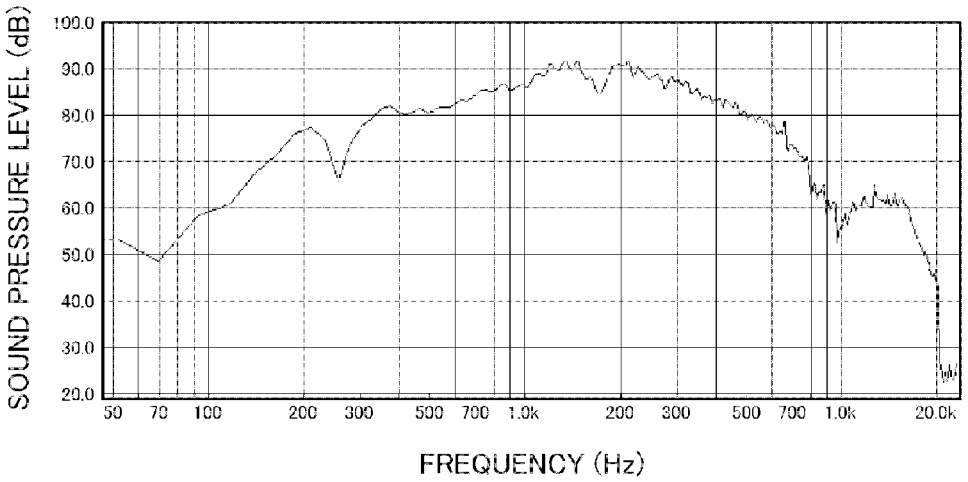
FIGS. 23A and 23B are diagrams illustrating frequency characteristics of the speaker system of the present invention.
Figure 23B:
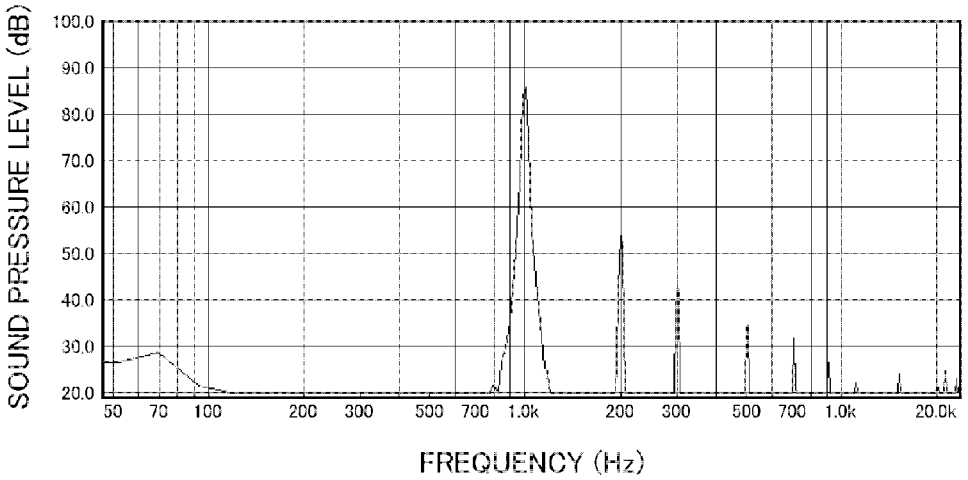

The measurement result of the sine wave sweep measurement is shown in FIG. 23A, and the measurement result when a sine wave at 1 kHz was input is shown in FIG. 23B.

Example 12

The sound pressure level-frequency characteristics were measured in the same manner as in Example 9, except that the piezoelectric speaker having the viscoelastic support 46 illustrated in FIG. 2 was used.

The viscoelastic support 46 was glass wool having a height of 25 mm and a density of 32 kg/m$^3$ before assembly.

Figure 24A:
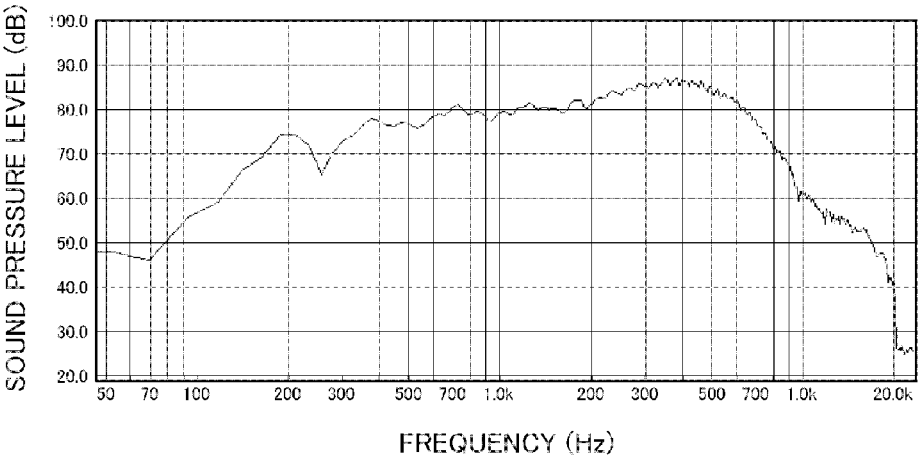
FIGS. 24A and 24B are diagrams illustrating frequency characteristics of the speaker system of the present invention.
Figure 24B:
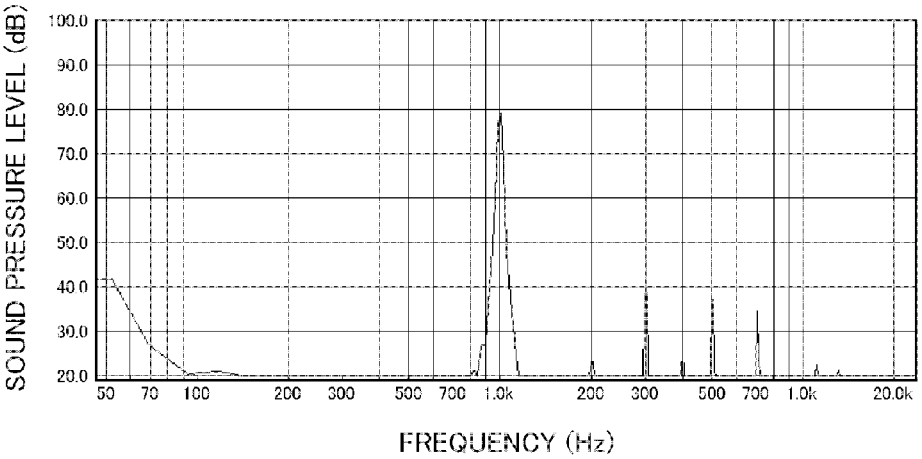

The measurement result of the sine wave sweep measurement is shown in FIG. 24A, and the measurement result when a sine wave at 1 kHz was input is shown in FIG. 24B.

Reference Example 1

The sound pressure level-frequency characteristics were measured in the same manner as in Example 9, except that a constant voltage type power amplifier was used as the driving circuit. That is, a configuration in which correction of attenuating the input signal from the signal source 250 at a rate of 6 dB/octave is not performed was adopted.

Figure 25A:
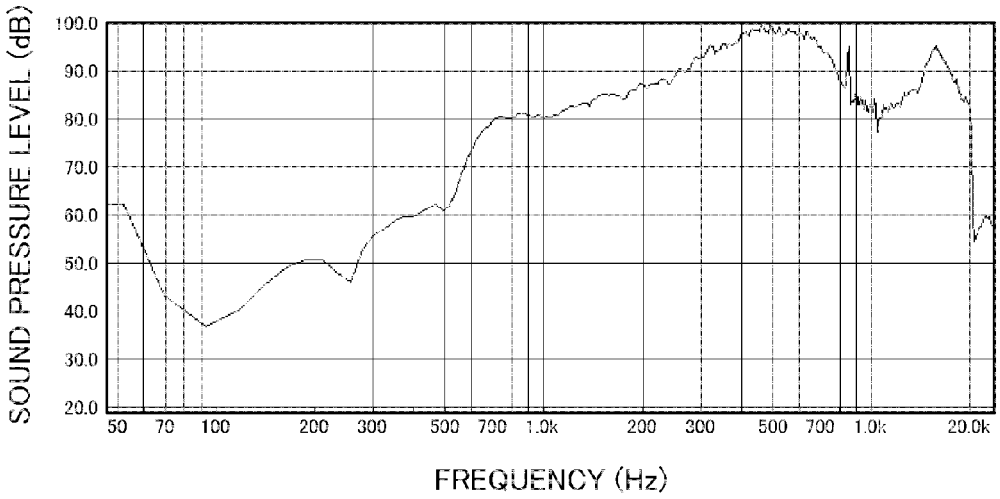
FIGS. 25A and 25B are diagrams illustrating frequency characteristics of the speaker system of the present invention.
Figure 25B:
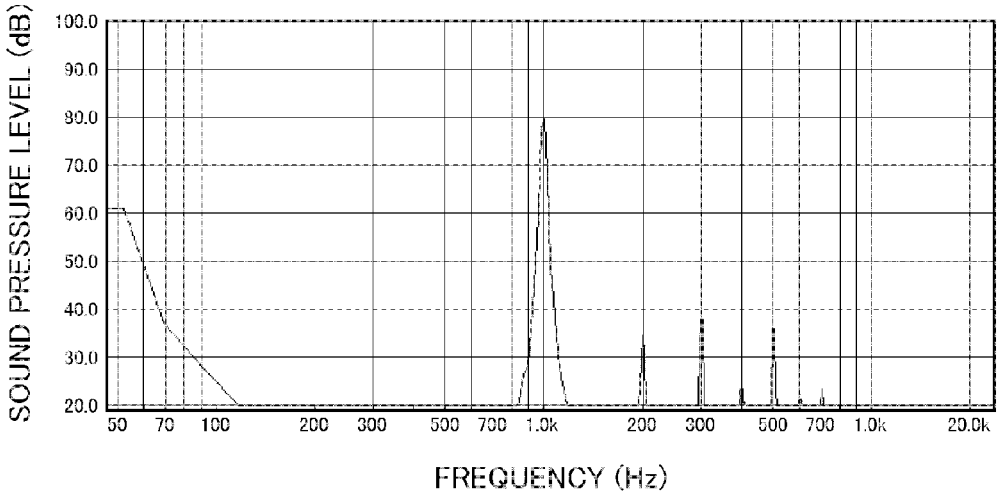

The measurement result of the sine wave sweep measurement is shown in FIG. 25A, and the measurement result when a sine wave at 1 kHz was input is shown in FIG. 25B.

Reference Example 2

The sound pressure level-frequency characteristics were measured in the same manner as in Example 10, except that a constant voltage type power amplifier was used as the driving circuit.

Figure 26A:
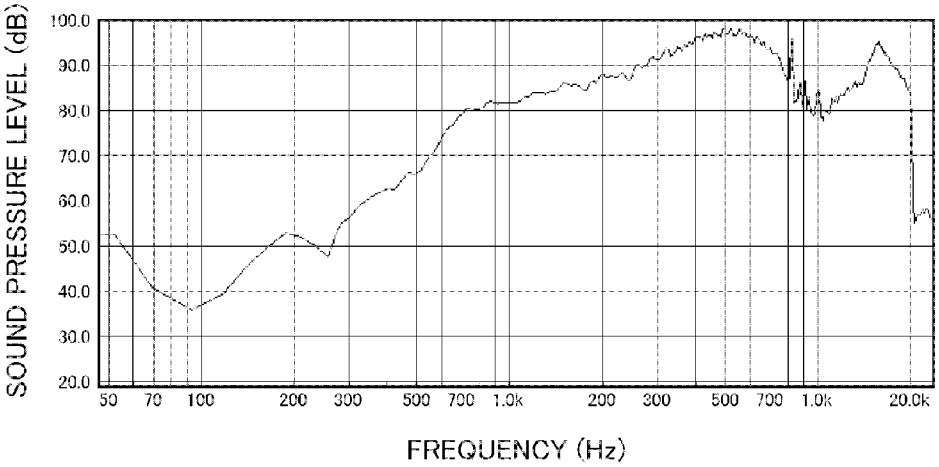
FIGS. 26A and 26B are diagrams illustrating frequency characteristics of the speaker system of the present invention.
Figure 26B:
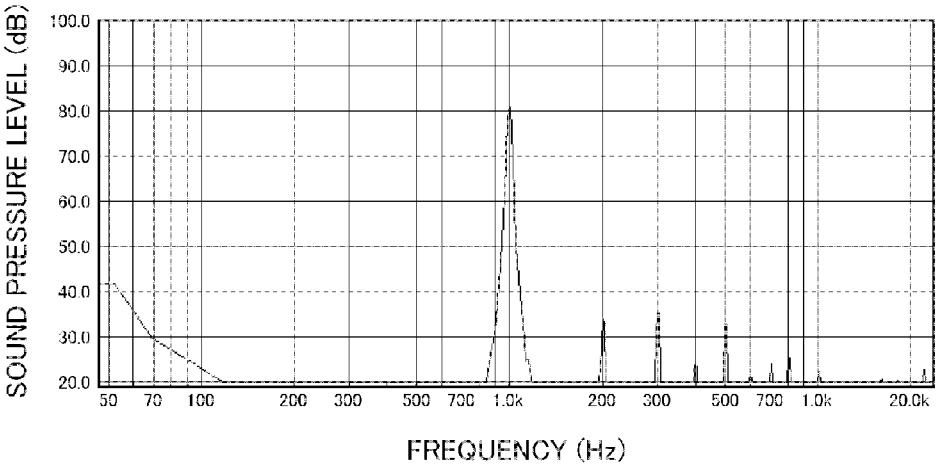

The measurement result of the sine wave sweep measurement is shown in FIG. 26A, and the measurement result when a sine wave at 1 kHz was input is shown in FIG. 26B.

Reference Example 3

The sound pressure level-frequency characteristics were measured in the same manner as in Example 11, except that a constant voltage type power amplifier was used as the driving circuit.

Figure 27A:
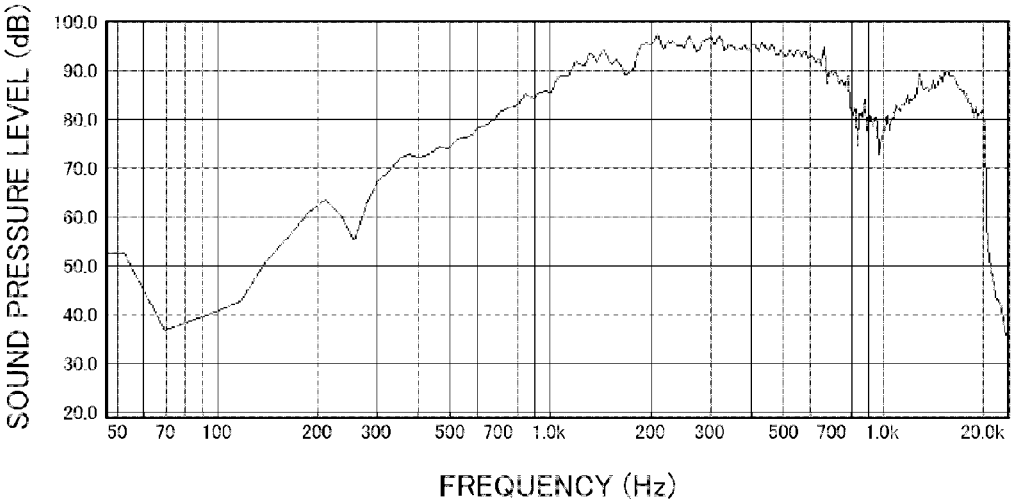
FIGS. 27A and 27B are diagrams illustrating frequency characteristics of the speaker system of the present invention.
Figure 27B:
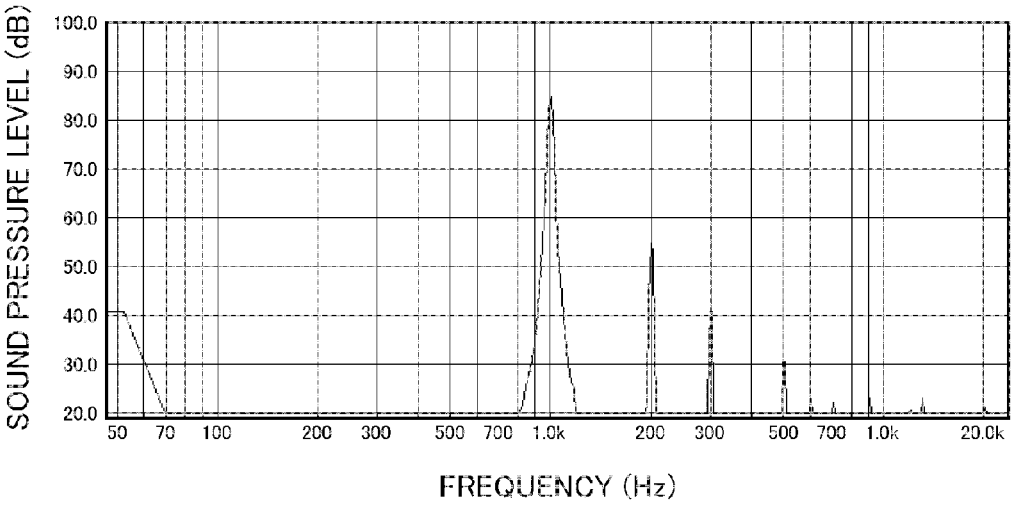

The measurement result of the sine wave sweep measurement is shown in FIG. 27A, and the measurement result when a sine wave at 1 kHz was input is shown in FIG. 27B.

Reference Example 4

The sound pressure level-frequency characteristics were measured in the same manner as in Example 12, except that a constant voltage type power amplifier was used as the driving circuit.

Figure 28A:
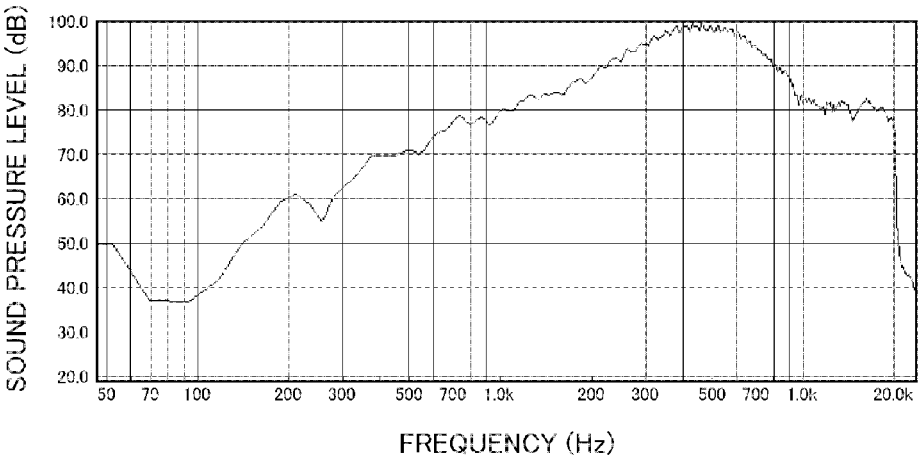
FIGS. 28A and 28B are diagrams illustrating frequency characteristics of the speaker system of the present invention.
Figure 28B:
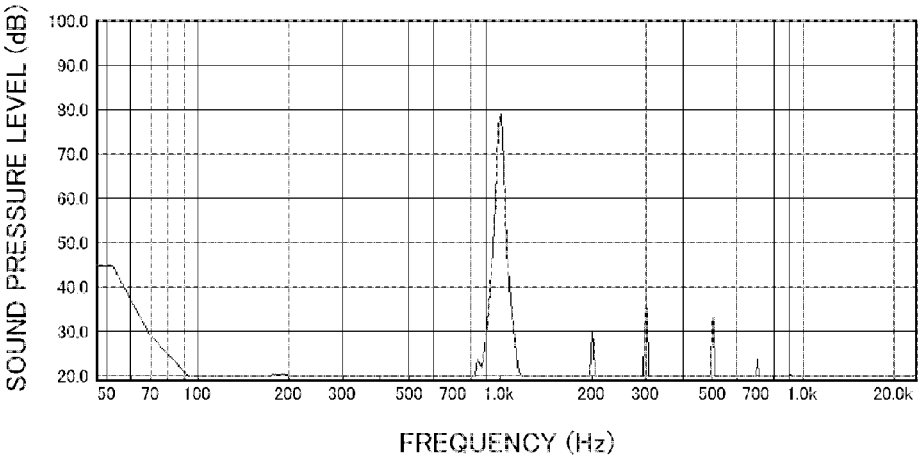
Figure 29:
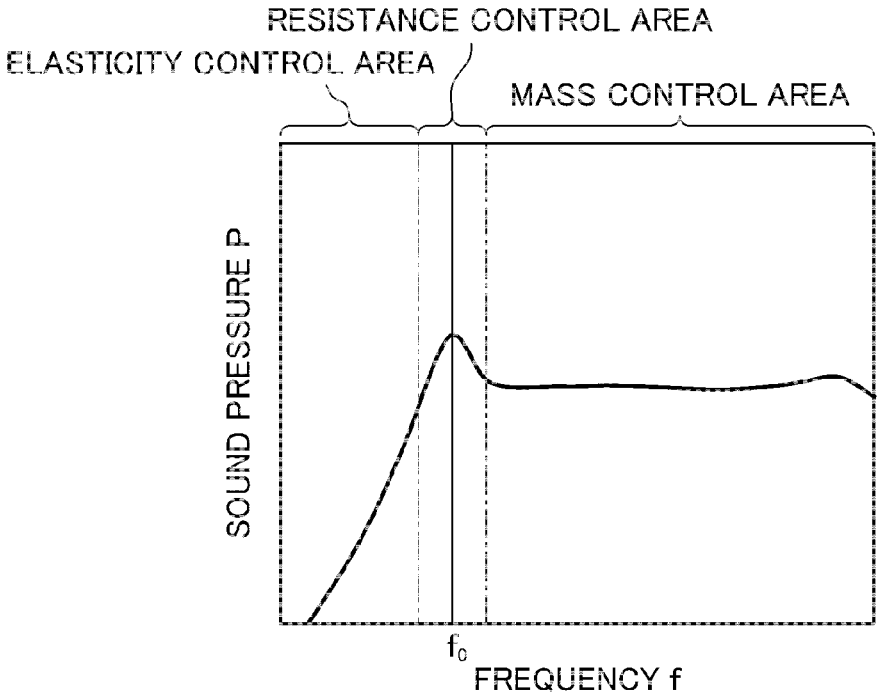
FIG. 29 is a graph conceptually illustrating frequency characteristics of a conventional speaker system.
Figure 30:
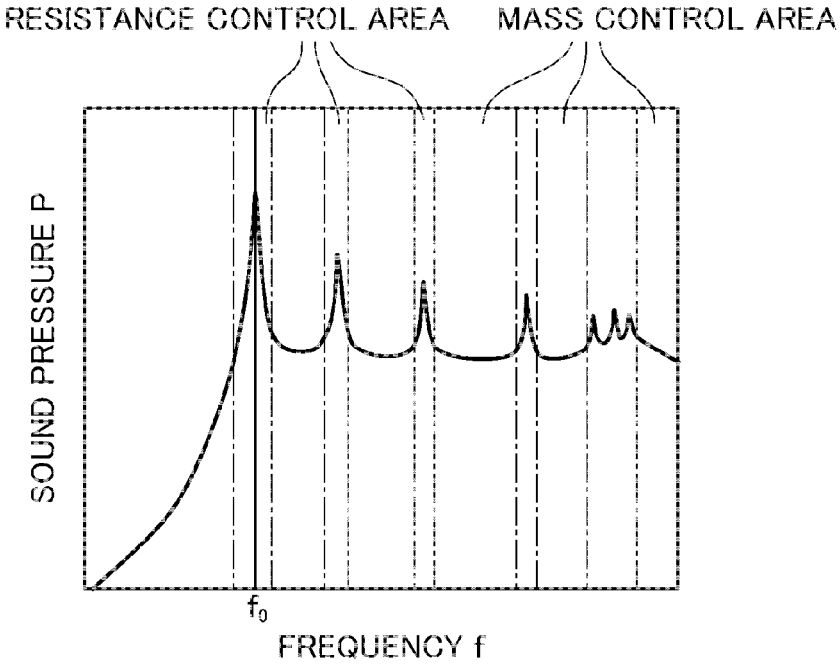
FIG. 30 is a graph conceptually illustrating frequency characteristics of a conventional speaker system.

The measurement result of the sine wave sweep measurement is shown in FIG. 28A, and the measurement result when a sine wave at 1 kHz was input is shown in FIG. 28B.

From FIGS. 25A, 26A, 27A, and 28A, it is understood that the piezoelectric speakers in Reference Examples 1 to 4, in which the converter film using the cyanoethylated PVA exhibiting viscoelasticity at normal temperature as the matrix is used, exhibit frequency characteristics having a gradient of 6 dB/octave.

Furthermore, in Reference Example 1, it is understood that the vibration mode in a longitudinal direction is weak (a band of 100 Hz to 500 Hz). This is because tension applied to the converter film 10 is small, and thus, the center area of the converter film hangs due to the self-weight thereof and the amplitude of a fundamental vibration, which exhibits the maximum amplitude at the center area, decreases.

In Reference Example 2, since the tension is applied by the internal pressure of the case 42, the hanging of the film is reduced, and thus, the amplitude of the fundamental vibration or a secondary vibration can be increased, as compared to Reference Example 1. Further, it is understood that, since the air resistance by the internal pressure of the case 42 is added and accordingly, the Q value is decreased, the frequency characteristics become slightly smoother, as compared to Reference Example 1.

Moreover, in Reference Example 3 in which the internal pressure is increased, it is understood that sufficient tension is applied to the converter film 10, and thus, the vibration mode (fundamental vibration) in a longitudinal direction is also activated. On the other hand, it is understood that a piston motion caused by the air spring is added and a resonance point thereof is generated in the vicinity of 1.7 kHz. Accordingly, it is also understood that in a frequency band of which the frequencies are equal to or higher than that of the resonance point, the mass control area is formed and the frequency characteristics are uniformized.

From the graphs of frequency characteristics when a sine wave at 1 kHz was input that are shown in FIGS. 25B, 26B, and 27B, it is understood that a component (distortion component) other than 1 kHz is increased as the internal pressure is increased. That is, it is understood that an output of a frequency other than the input frequency is increased, and thus, the sound quality is degraded.

In contrast, in Reference Example 4 in which the viscoelastic support 46 is included, it is understood that tension can be applied to the entire converter film 10 without causing resonance such as the air spring in Reference Example 3, the resistance control area can be widened, and the frequency characteristics become smooth. Further, from the graph of frequency characteristics when a sine wave at 1 kHz was input, that is shown in FIG. 28B, it is understood that a distortion component other than 1 kHz is small, and thus, degradation of sound quality is also small.

From FIGS. 21A, 22A, 23A, and 24A, it is understood that the frequency characteristics are substantially uniform in Examples 1 to 4 in which the input signal from the signal source 250 is attenuated at a rate of 6 dB/octave using the constant current type power amplifier to apply an output voltage.

Furthermore, in Example 1, it is understood that since the tension of the converter film 10 is small, the vibration mode in a longitudinal direction is weak and the sound pressure level in a band of 100 Hz to 500 Hz is small. In Examples 2 and 3 in which the internal pressure is applied, it is understood that since the air resistance is added and the Q value decreases, the frequency characteristics become smooth as compared to Reference Example 1.

However, from FIGS. 21B, 22B, and 23B, it is understood that as the inner pressure is increased, a distortion component is increased and sound quality is degraded.

In Example 3, it is understood that since a resonance point is generated in the vicinity of 1.7 kHz, and the frequency characteristics are uniform in a frequency band of which the frequencies are equal to or higher than that of the resonance point before the correction of 6 dB/octave is performed (Reference Example 3), the resistance control area becomes narrow.

In contrast, in Example 4 in which the viscoelastic support 46 is included, it is understood that it is possible to uniformize the frequency characteristics in a wide frequency range. Further, from the graph of frequency characteristics when a sine wave at 1 kHz was input, that is shown in FIG. 24B, it is understood that a distortion component is small and degradation of sound quality is also small. This is because, if the converter film is supported by the viscoelastic support such as glass wool, tension can be applied without causing resonance, and the resistance control area can be widened.

From the above results, the effects of the present invention are apparent.

What is claimed is:

1. A speaker system comprising:

an electroacoustic converter film composed of a polymeric composite piezoelectric body in which piezoelectric body particles are dispersed in a viscoelastic matrix formed of a polymer material that exhibits viscoelasticity at normal temperature, and thin film electrodes formed on both surfaces of the polymeric composite piezoelectric body; and a driving circuit that attenuates signal intensity of an input signal from a signal source at a rate of 5 dB to 7 dB per octave and supplies the attenuated input signal to the electroacoustic converter film, wherein a maximum value of a loss tangent (Tan δ) at a frequency of 1 Hz of the electroacoustic converter film, which is 0.1 or higher, is present at normal temperature.

2. The speaker system according to claim 1, wherein the electroacoustic converter film has a protective layer that is formed on a surface of at least one of the thin film electrodes.

3. The speaker system according to claim 1, wherein the driving circuit attenuates the signal intensity of the input signal at a rate of 6 dB per octave and supplies the attenuated input signal to the electroacoustic converter film.

4. The speaker system according to claim 3, wherein the driving circuit includes a low pass filter that attenuates the signal intensity of the input signal of which a frequency is equal to or higher than a predetermined first cutoff frequency at a rate of 6 dB per octave, and a constant voltage type amplifier that amplifies the input signal.

5. The speaker system according to claim 4, wherein the first cutoff frequency is a frequency lower than a lowest resonance frequency of the electroacoustic converter film.

6. The speaker system according to claim 1, wherein the driving circuit includes a constant current type amplifier that amplifies the input signal.

7. The speaker system according to claim 4, wherein the driving circuit further includes a high pass filter that attenuates the signal intensity of the input signal of which a frequency is equal to or lower than a predetermined second cutoff frequency.

8. The speaker system according to claim 7, wherein the second cutoff frequency is equal to or lower than the first cutoff frequency.

9. The speaker system according to claim 6, wherein the driving circuit further includes a high pass filter that attenuates the signal intensity of the input signal of which a frequency is equal to or lower than a predetermined second cutoff frequency.

10. The speaker system according to claim 1, further comprising a viscoelastic support that is disposed in close contact with at least one main surface of the electroacoustic converter film.

11. The speaker system according to claim 10, wherein the viscoelastic support comprises at least one of glass wool, paper, polyurethane, a magnetic fluid, polyester wool, a coating material, and felt.

12. The speaker system according to claim 1, wherein the polymer material is one or more selected from a group consisting of cyanoethylated polyvinyl alcohol, polyvinyl acetate, polyvinylidene chloride co-acrylonitrile, a polystyrene-vinyl polyisoprene block copolymer, polyvinyl methyl ketone, and polybutyl methacrylate.

13. The speaker system according to claim 1, wherein the polymer material has a cyanoethyl group or a cyanomethyl group.

14. The speaker system according to claim 1, wherein a storage modulus (E') at a frequency of 1 Hz of the electroacoustic converter film that is obtained by dynamic viscoelasticity measurement is 10 GPa to 30 GPa at 0° C. and 1 GPa to 10 GPa at 50° C.

15. The speaker system according to claim 1, wherein a product of a thickness of the electroacoustic converter film and a storage modulus (E') at a frequency of 1 Hz of the electroacoustic converter film that is obtained by dynamic viscoelasticity measurement is $1.0\times10^6$ N/m to $2.0\times10^6$ N/m at 0° C. and $1.0\times10^5$ N/m to $1.0\times10^6$ N/m at 50° C.

16. The speaker system according to claim 1, wherein a loss tangent (Tan δ) at a frequency of 1 kHz at 25° C. of the electroacoustic converter film is 0.05 or higher in a master curve obtained by dynamic viscoelasticity measurement.

* * * * *